United States Patent [19]

Muramatsu et al.

[11] Patent Number: 4,498,810

[45] Date of Patent: Feb. 12, 1985

[54] COLLAPSIBLE RUBBER DAM

[75] Inventors: Tateo Muramatsu, Yokohama; Mamoru Kurihara, Tokyo; Yasushi Enami, Yokohama, all of Japan

[73] Assignee: Bridgestone Tire Company Limited, Tokyo, Japan

[21] Appl. No.: 238,892

[22] Filed: Feb. 27, 1981

[30] Foreign Application Priority Data

| | | | |
|---|---|---|---|
| Mar. 6, 1980 | [JP] | Japan | 55-27,273 |
| Jun. 27, 1980 | [JP] | Japan | 55-87,480 |
| Jul. 24, 1980 | [JP] | Japan | 55-100,477 |
| Aug. 25, 1980 | [JP] | Japan | 55-115,817 |

[51] Int. Cl.[3] ..... E02B 7/20

[52] U.S. Cl. ..... 405/115; 405/91

[58] Field of Search ..... 405/91, 107, 115, 87

[56] References Cited

U.S. PATENT DOCUMENTS

| | | | |
|---|---|---|---|
| 3,173,269 | 3/1965 | Imbertson | 405/115 X |
| 3,786,638 | 1/1974 | Fish | 405/115 |
| 3,834,167 | 9/1974 | Tabor | 405/115 |
| 4,299,514 | 11/1981 | Muramatsu et al. | 405/115 |
| 4,330,224 | 5/1982 | Muramatsu et al. | 405/115 |

*Primary Examiner*—David H. Corbin

*Attorney, Agent, or Firm*—Sughrue, Mion, Zinn, Macpeak & Seas

[57] ABSTRACT

A collapsible rubber dam secured to a riverbed portion and slope portions of both riverbanks is inflated and deflated by supply and discharge of a fluid. A pipe for supply and discharge of a fluid is communicated with the inside of the rubber dam from the shape portion of at least one riverbank except the riverbed portion securing the rubber dam. Preferably, the pipe for supply and discharge of the fluid is located in a region defined by a top end of the rubber dam located in the slope portion, a line connecting the top end of the rubber dam to substantially a middle position of a deflated width of the rubber dam at a toe of the slope portion, and a securing position of the rubber dam at the toe of the slope portion.

5 Claims, 57 Drawing Figures

10
16
15
Y

COLLAPSIBLE RUBBER DAM

This invention relates to an improvement in collapsible rubber dams which are used as an intake dam for irrigation water, a tide embankment against storm surge, a barrier for damming seawater near a mouth of a river and the like.

A water-level regulating barrier for taking irrigation water or damming seawater at the mouth of a river, has recently been developed composed of a rubbery sheet material, or so-called collapsible rubber dams, which are operated by direct supply of a fluid such as air, water or the like and are easy in their installation and maintenance. At present, most of these rubber dams are in practice. In these rubber dams, however, it is necessary to perform the inflation and deflation of the rubber dam by the supply and discharge of a fluid such as air, water or the like.

Heretofore, the inflation and deflation of the rubber dam have been performed by using a pipe-line for the supply and discharge of the fluid as schematically shown in FIG. 1. This pipe-line comprises a horizontal pipe 2 laid in a riverbed and a plurality of conduits 3 communicating the horizontal pipe 2 with a rubber dam 1. Moreover, a fluid pumping device inclusive of a pump, discharge port and the like, which is connected to the horizontal pipe 2, is usually arranged in an operating chamber standing on one of the riverbanks.

In the illustrated pipe-line, a fluid such as air or the like is pumped into the inside of the rubber dam 1 through the horizontal pipe 2 and conduits 3 by means of a pump or the like (not shown) to inflate the rubber dam 1. However, moisture contained in air is condensed during the pumping to form a drain, which remains in the rubber dam and pipe. Particularly, when using the conventional pipe-line as shown in FIG. 1, the drain remains in the horizontal pipe 2 laid in the riverbed. Now, if it is desired to deflate the rubber dam by the discharge of the enclosed air, a valve $V_1$ is first opened to remove the drain from the horizontal pipe 2 and then a valve $V_2$ is opened to discharge the enclosed air from the inside of the rubber dam. Therefore, the deflation operation of the rubber dam is troublesome and inefficient. And also, the working method for laying the pipe in the riverbed becomes complicated and takes a long time.

Further, when the rubber dam is automatically deflated (which is usually performed by the automatic opening of a float valve) in case of such an emergency that the water level in the river abnormally increases due to flood or others, if the drain produced by condensation phenomenon remains in the pipe-line, the enclosed air cannot be discharged from the rubber dam. Moreover, the drain may break the pipe due to freezing.

It is, therefore, an object of the invention to eliminate the above mentioned drawbacks of the prior art rubber dam and to provide a collapsible rubber dam provided with a piping for the supply and discharge of fluid, which can deflate the rubber dam by atmospheric discharge every time without laying piping beneath the riverbed and without staying the drain in any portion of the piping.

It is another object of the invention to provide a collapsible rubber dam provided with a piping for supply and discharge of fluid, a port opening of which is arranged in such a position that a stress is not significantly applied to the port opening even in the case of the change of water level and occurrence of back flow.

According to the invention, there is the provision of a collapsible rubber dam secured to a riverbed portion and slope portions of both riverbanks only at an upstream side of a river and fulfilling the inflation and deflation functions by supply and discharge of a fluid. An end of a pipe for supply and discharge of said fluid communicates with the inside of the rubber dam from the slope portion of at least one riverbank except the riverbed portion securing the rubber dam.

In a preferred embodiment of the invention, the end of the pipe for supply and discharge of the fluid is located in a region defined by a tope end of the rubber dam located in the slope portion, a line connecting the top end of the rubber dam to substantially a middle position of a deflated width of the rubber dam at the toe of the slope portion, and a securing position of the rubber dam at the toe of the slope portion.

In another preferred embodiment of the invention, the pipe for supply and discharge of the fluid communicates with the inside of the rubber dam from the slope portions of both the riverbanks except the riverbed portion securing the rubber dam and above an acceptable height of a remaining drain in the rubber dam.

In order to achieve complete deflation of the rubber dam, according to the invention, the rubber dam is provided at its inside with at least one protruding member having a rigidity to withstand water pressure and extending along the longitudinal direction of the rubber dam.

According to the invention, an elastic element capable of deforming in accordance with the inflating shape of the rubber dam is located in at least a part of the rubber dam or a dam height at inflation of the rubber dam is lowered in at least a position along the widthwise direction of the river in order to shorten the complete deflating time of the rubber dam.

The invention will now be described in detail with reference to the accompanying drawings, wherein.

Figure 6:
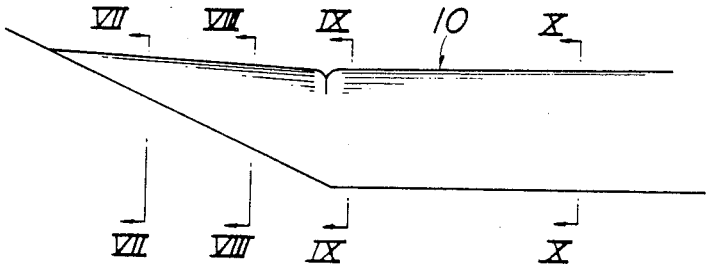
FIG. 6 is a schematically left-half front view of the collapsible rubber dam according to the invention.
Figure 11:
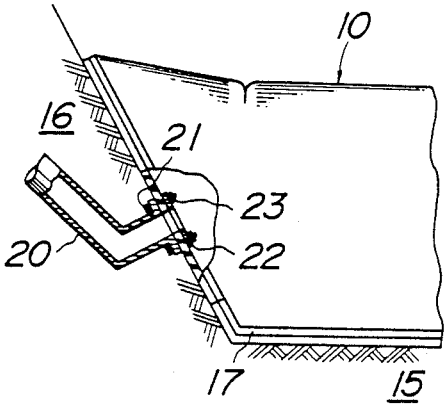
Figure 12:
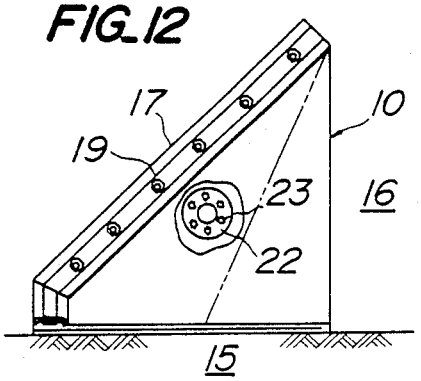
Figure 13:
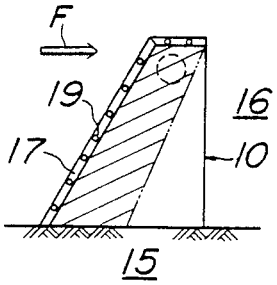
Figure 14:
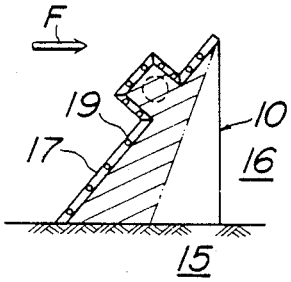
Figure 15:
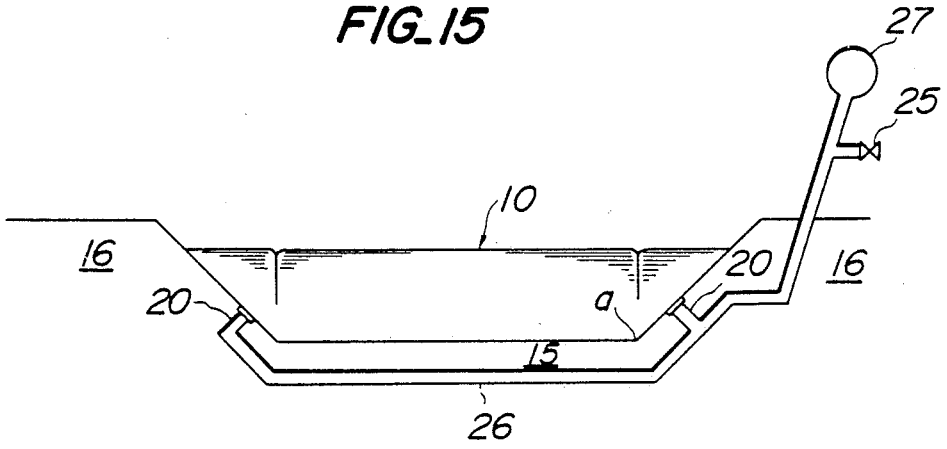
Figure 16:
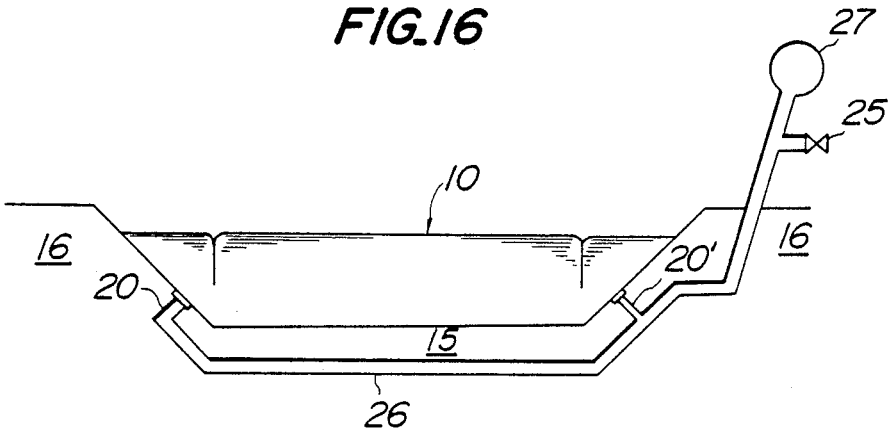
Figure 17:
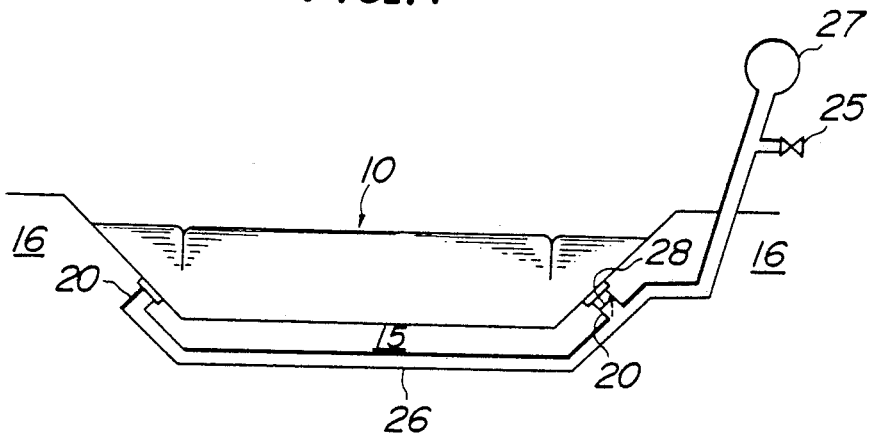
Figure 18:
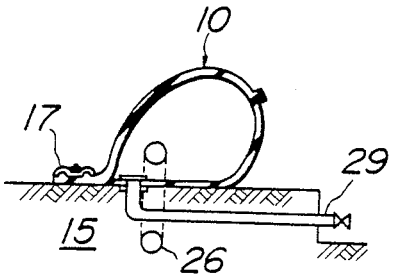
Figure 19:
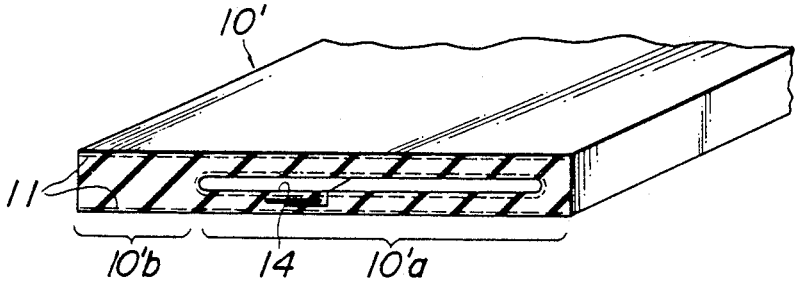
Figure 20:
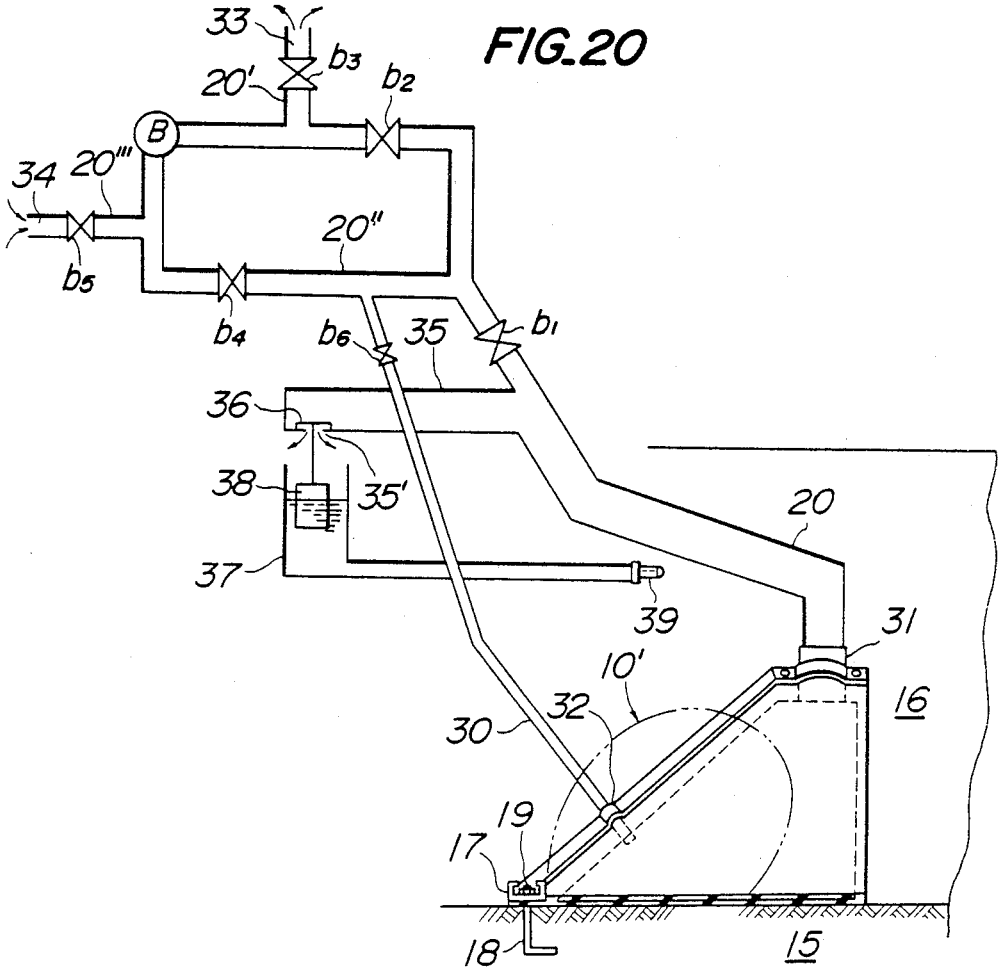
Figure 21:
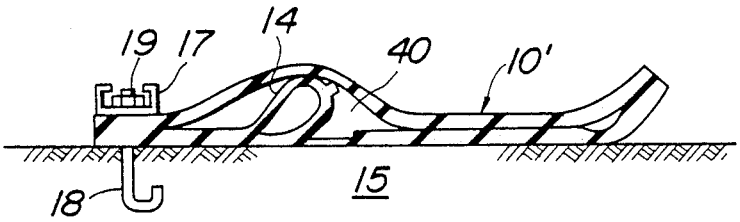
Figure 22:
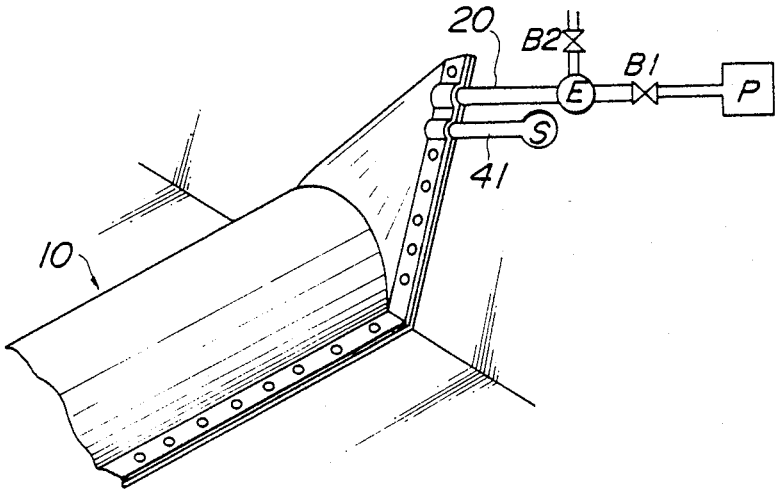
Figure 23:
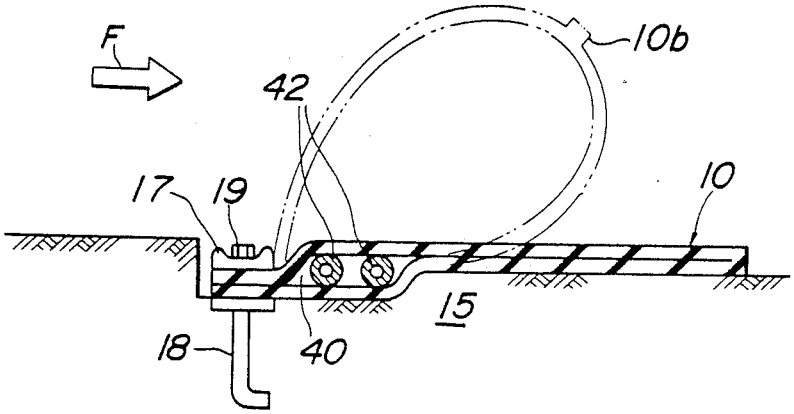
Figure 24:
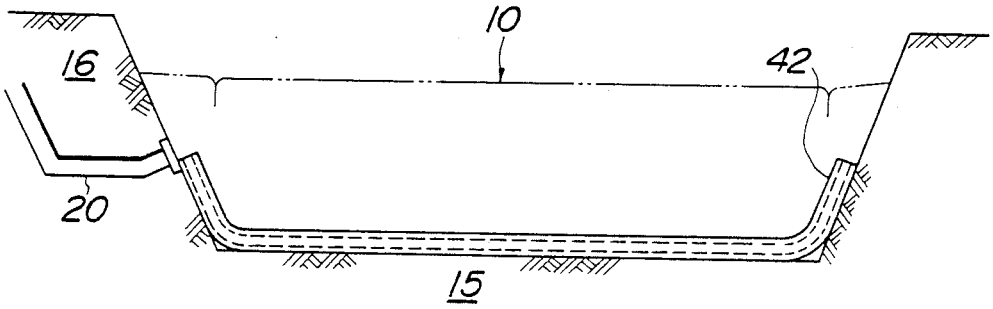
Figure 25:
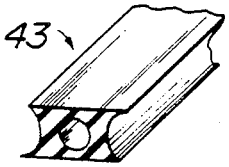
Figure 26A:
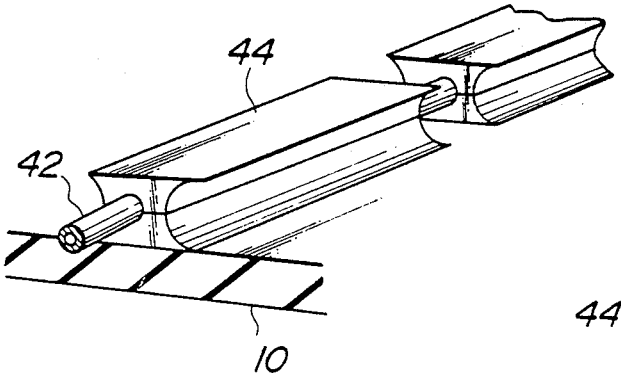
Figure 26B:
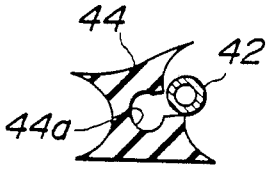
Figure 27:
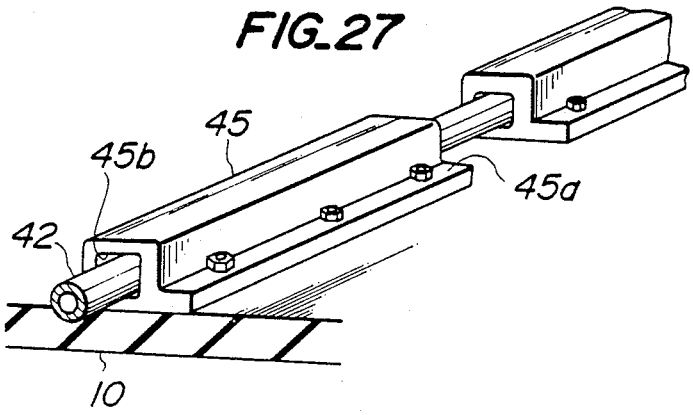
Figure 28:
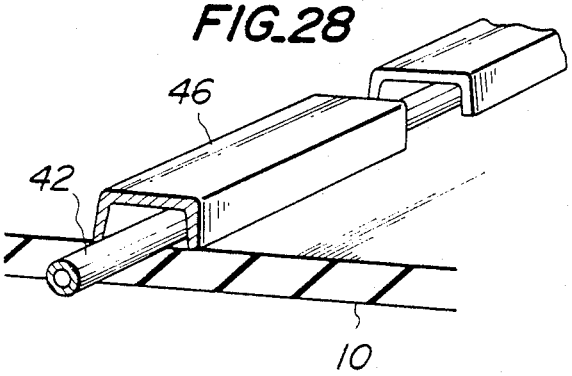
Figure 29:
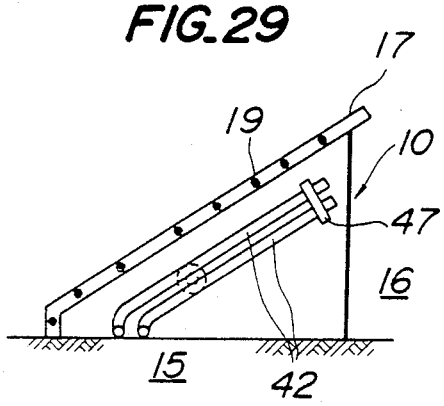
Figure 30:
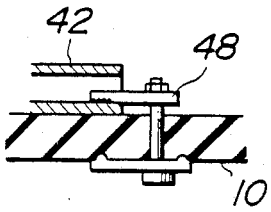
Figure 31:
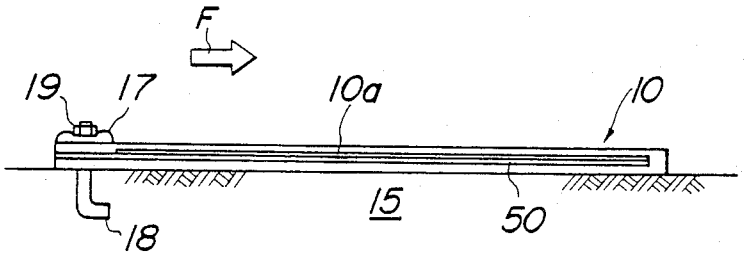
Figure 32:
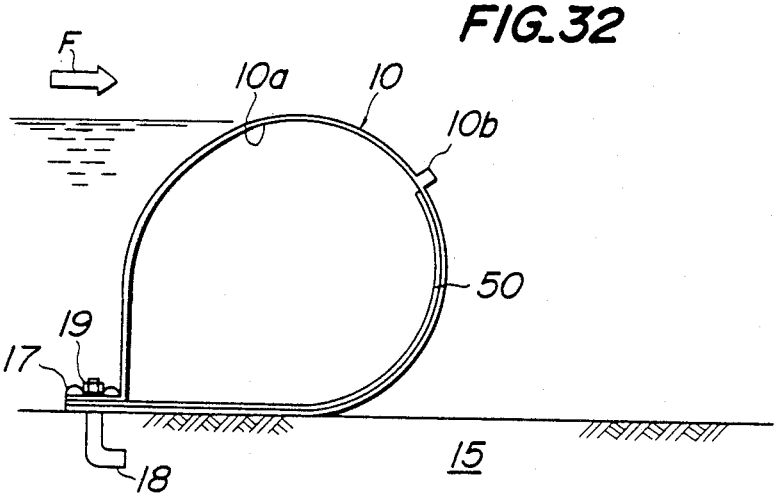
Figure 33:
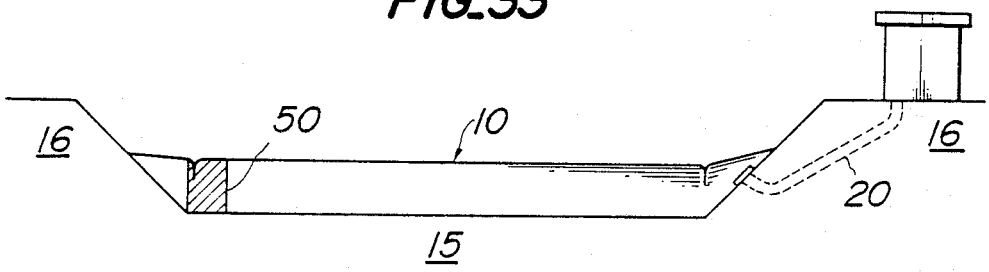
Figure 34:
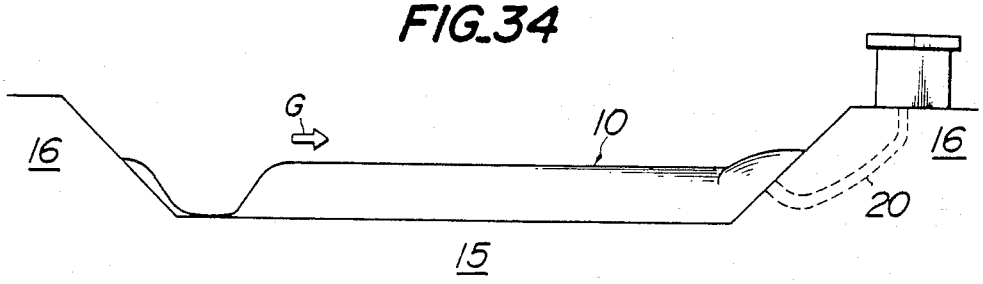
Figure 46:
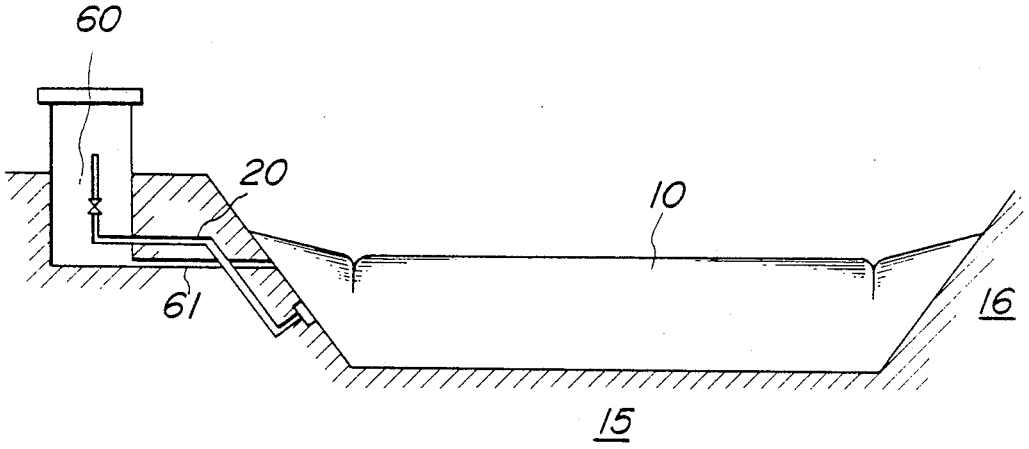
Figure 47:
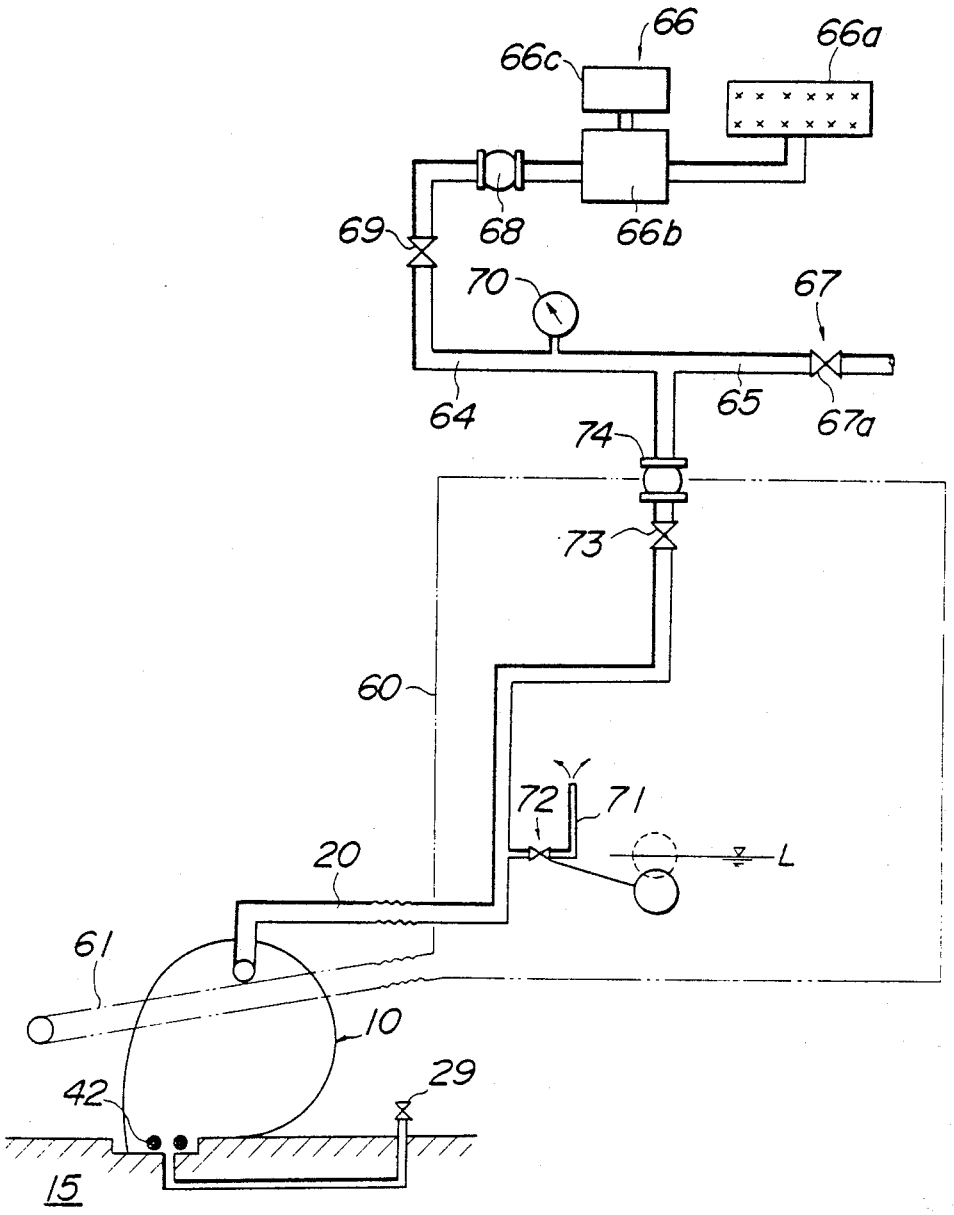
Figure 48:
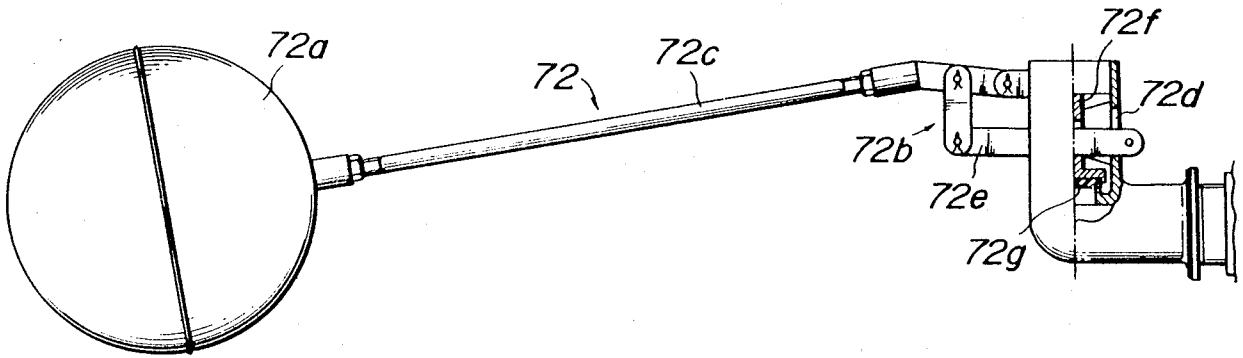

FIGS. 7*a*, 8*a*, 9*a* and 10*a* are schematic sectional views taken along lines VII—VII, VIII—VIII, IX—IX and X—X of FIG. 6 in a direct flow state, respectively;

FIGS. 7*b*, 8*b*, 9*b* and 10*b* are schematic sectional views taken along lines VII—VII, VIII—VIII, IX—IX and X—X of FIG. 6 in a back flow state, respectively;

FIGS. 11 and 12 are a front view partly shown in section and a side view illustrating the fitted state of a pipe for the supply and discharge of a fluid to the collapsible rubber dam according to the invention, respectively;

FIGS. 13 and 14 are schematic views illustrating another embodiments of the fitted state of the pipe for supply and discharge of the fluid to the collapsible rubber dam according to the invention at the slope portion of the riverbank, respectively;

FIG. 15 is a schematic view of an embodiment of the pipe-line to be used in the invention;

FIGS. 16 and 17 are schematic views of another embodiment of the pipe-line to be used in the invention, respectively;

FIG. 18 is a sectional view of the collapsible rubber dam according to the invention provided with a drain extracting pipe;

FIG. 19 is a perspective view of another embodiment of the flexible plate body used as the collapsible rubber dam according to the invention;

FIG. 20 is a schematic view of an embodiment of the pipe-line applicable to the collapsible rubber dam of FIG. 19;

FIG. 21 is a sectional view illustrating the deflated state of the collapsible rubber dam of FIG. 19;

FIG. 22 is a schematic view illustrating the neighborhood of the inlet port in the collapsible rubber dam according to the invention and the pipe-line used therefor;

FIG. 23 is a sectional view illustrating the secured state of the collapsible rubber dam provided with a continuous hollow body as a protruding member according to the invention to the riverbed;

FIG. 24 is a front view partly shown in section illustrating the inflated state of the collapsible rubber dam of FIG. 23;

FIG. 25 is a perspective view of another embodiment of the continuous hollow body to be used in the invention;

FIGS. 26–28 are schematic views illustrating the arranging manner of the continuous hollow body in the collapsible rubber dam according to the invention, respectively;

FIG. 29 is a schematic view illustrating the arrangement of the continuous hollow body inside the collapsible rubber dam in the slope portion of the riverbank;

FIG. 30 is a partly sectional view of an embodiment of the fitting means for the continuous hollow body according to the invention;

FIG. 31 is sectional view illustrating the secured state of the collapsible rubber dam provided with an elastic element according to the invention to the riverbed;

FIG. 32 is a schematic sectional view illustrating the inflated state of the collapsible rubber dam of FIG. 31;

FIGS. 33 and 34 are schematic views illustrating the deflating state of the collapsible rubber dam of FIG. 32 with lapse of time, respectively;

FIGS. 35–45 are schematic views of various embodiments of the collapsible rubber dam according to the invention;

FIG. 46 is a schematic view of an embodiment of the pipe-line for the fluid applicable to the invention;

FIG. 47 is a detail view of the pipe-line shown in FIG. 46;

FIG. 48 is an enlarged view of the lever float valve to be used in the invention; and FIGS. 49–52 are schematic views of another embodiment of the pipe-line applicable to the invention, respectively.

Like parts are designated by like numerals and like symbols throughout the different figures of the drawing.

Figure 2:
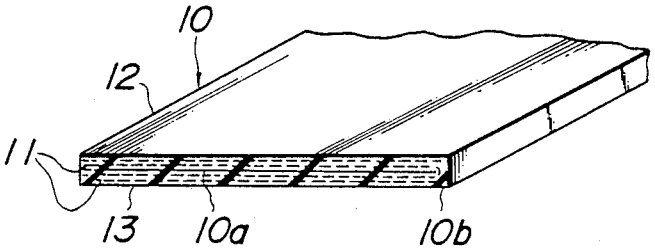
FIGS. 2 and 3 are perspective views of an embodiment of the flexible plate body used as a collapsible rubber dam according to the invention, respectively.
Figure 3:
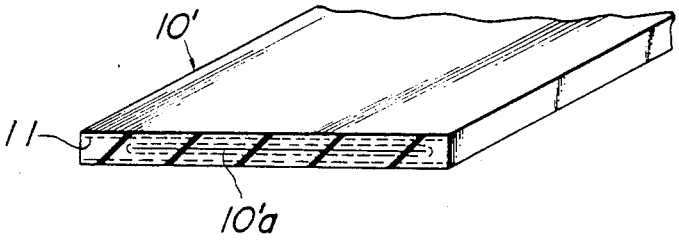

In FIGS. 2 and 3 are shown a preferred embodiment of the flexible plate body to be used in the invention, respectively. This flexible plate body is composed of a rubbery elastic material and has at least one split portion formed at a predetermined position in a thickness direction of the body and along a lengthwise direction thereof. In FIG. 2, a flexible plate body 10 is opened at its one widthwise end by a split portion 10*a*. In FIG. 3, a flexible plate body 10' is a hollow plate body containing a split portion 10'*a*. In the figure, numeral 11 is a reinforcing material such as canvas, bias cut weave fabric and the like for the reinforcement of the flexible plate body.

The flexible plate bodies shown in FIGS. 2 and 3 are preferable embodiments and are not intended as limitations thereof. According to the invention, use may also be made of, for instance, a bag-like body of a rubbery sheet material usually used, a rubber dam body wherein a riverbed constitutes a part of an inflating chamber, and the like.

The flexible plate body 10 of FIG. 2 is formed by joining two piled rubber sheets 12, 13 to each other at their one widthwise end along the lengthwise direction thereof as a whole.

The manufacture of the flexible plate body 10 is carried out as follows. For instance, two crude rubber sheets corresponding to the rubber sheets 12, 13 are piled one upon the other and placed on a heat surface plate of a molding press. Then, an antitack member is interposed between the crude rubber sheets along the lengthwise direction thereof to leave only end portions of the sheets in a contact state. Thereafter, the crude rubber sheet assembly is pressed at a vulcanizing temperature of the crude rubber sheet to obtain the flexible plate body 10. In this case, a desirable reinforcing layer can be obtained by properly embedding a canvas or the like in the crude rubber sheet.

The obtained plate bodies 10 are well adaptable as a collapsible rubber dam to rivers, streams, channels and the like, which have various different widths, because they can be manufactured with a desired length. Further, the gauge of the rubber sheets 12, 13 can freely be selected because the plate body is manufactured by the one-piece press molding of the crude rubber sheets.

Figure 4:
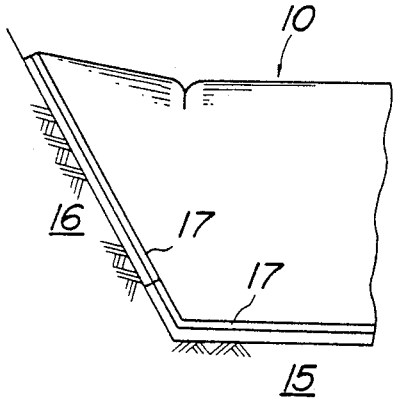
FIGS. 4 and 5 are a partly front view and a side view of the neighborhood of one end portion of the collapsible rubber dam according to the invention, respectively.

The flexible plate body 10 is secured to riverbed and riverbank as follows with reference to FIGS. 4 and 5.

First, the open end portion of the flexible plate body 10 is positioned toward an upstream side of a river (in this case, the direction of stream is shown by an arrow F in FIG. 13). Then, holes (not shown) pierced in the open end portion receive respective anchor bolts 18 previously embedded in a riverbed 15 and the slope portion 16 of a riverbank. Thereafter, the open end portion of the flexible plate body 10 is secured to the riverbed 15 and the riverbank 16 through an elongated and perforated keep member 17 by means of nuts 19.

According to the invention, a pipe for supply and discharge of fluid (hereinafter referred to as a fluid entrance pipe) communicates with the inside of the flexible plate body of the collapsible rubber dam body from a slope portion of at least one riverbank. Particularly, it is preferable to locate the fluid entrance pipe in a region of the rubber dam body always contacting with the slope portion of the riverbank irrespective of the inflated and deflated states of the rubber dam and the direct and back flows of the stream.

In the infalted state of the rubber dam 10 as shown in FIG. 6 the sectional shapes of various parts taken along lines VII—VII, VIII—VIII, IX—IX and X—X are shown in FIGS. 7*a*–10*b*, wherein FIGS. 7*a*, 8*a*, 9*a* and 10*a* represent the case of direct flow, FIGS. 7*b*, 8*b*, 9*b* and 10*b* represent the case of back flow, and a dot-dash line Y represents a secured position of the rubber dam body to the riverbed and riverbank.

Figures 7A, 7B, 8A, 8B, 9A, 9B, 10A, 10B:
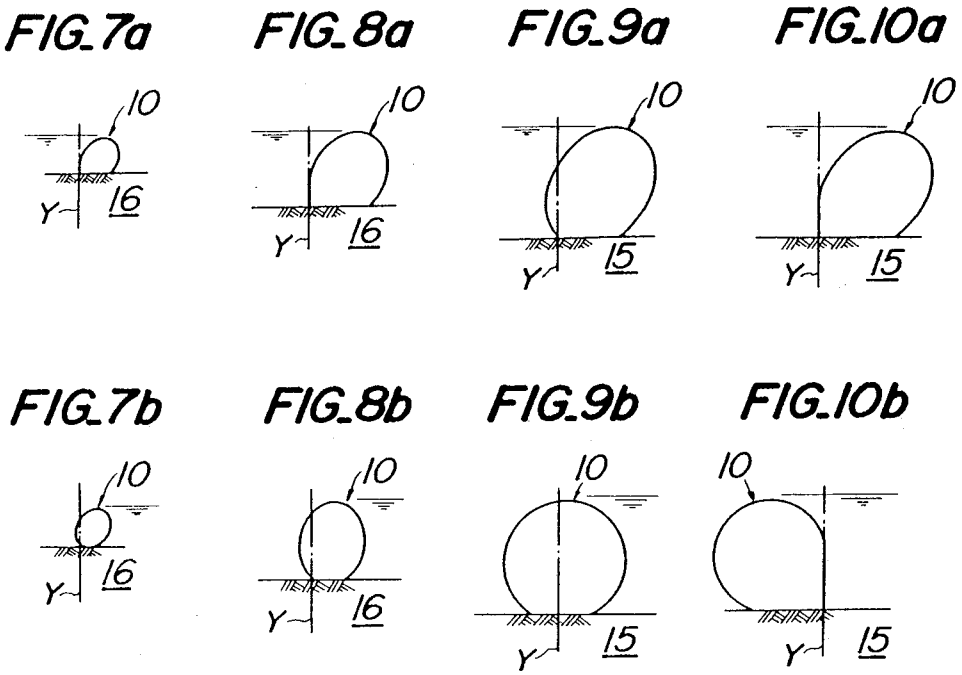

When the rubber dam body 10 is secured to the riverbed only at the upstream side of the river, if the back flow of the stream is produced by accident, the inflated portion of the rubber dam body located near the center of the width of the riverbed 15 falls from backward to forward as apparent from FIGS. 10*a* and 10*b*. Further, as apparent from FIGS. 7*b*, 8*b* and 9*b*, the back flow of the stream is apt to push up the rubber dam body at its secured position even in the vicinity of the boundary between the riverbed portion and the slope portion of the riverbank.

Figure 5:
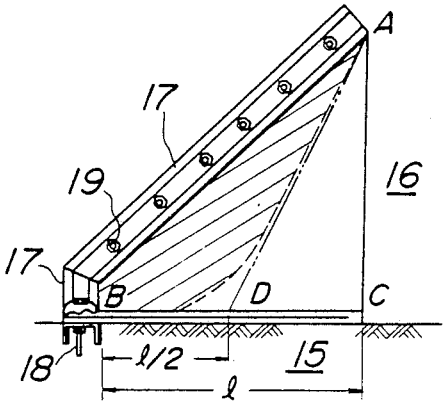

FIG. 5 also shows the contact state of the rubber dam body 10 with the slope portion 16 of the riverbank. In FIG. 5, character A represents a top end of the rubber dam body secured to the slope portion of the riverbank, character B a securing position of the rubber dam body at the toe of the slope portion, and character C another end of the rubber dam body opposite to the securing position B at the toe of the slope portion in the deflated state of the rubber dam body. As apparent from FIG. 5, the contact area of the rubber dam body 10 with the slope portion 16 in the deflated state is a region of ΔABC. Next, when the rubber dam body is inflated by the supply of the fluid at the direct flow state, the contact area changes from the region of ΔABC to a region of ΔABD. If the back flow occurs, the contact area reduces somewhat up to a shadowed region in the region of ΔABD.

Therefore, the position of a point D at the toe of the slope portion is very significant in the contact area during the inflation of the rubber dam body. As a result of various experiments, the inventors have found that when the distance BC is $\overline{BC}=l$ (l substantially corresponds to a width of the rubber dam body), the distance BD is $\overline{BD}\cong\frac{1}{2}l$. Thus, when the fluid entrance pipe is attached to the rubber dam body in such a manner that the attached portion of the fluid entrance pipe is located in a region from a line ($\overline{AD}$) connecting the top end of the rubber dam body at the slope portion to the middle position of the rubber dam body in its widthwise direction at the toe of the slope portion toward the upstream side of the river, a forcible stress is not significantly given to the attached portion of the pipe even in the case of the inflated and deflated states of the rubber dam body or the back flow state.

FIGS. 11 and 12 illustrate an embodiment of the attachment of the fluid entrance pipe to the rubber dam body according to the invention. In these figures, numeral 20 is a fluid entrance pipe, one end of which communicates with supply equipment such as a blower or the like and a discharge valve (not shown). The pipe 20 is disposed at substantially an upgrade so as not to leave the drain in the pipe. Moreover, the pipe 20 is somewhat bent near its port opening as shown in FIG. 11, but such a bending degree is insignificant even if the drain remains in the bent portion of the pipe because the drain may be pushed out into the inside of the rubber dam body during pumping of the fluid. In any case, it can be said that the pipe 20 as shown in FIG. 11 is disposed at substantially an upgrade.

When the pipe 20 is attached to the rubber dam body at the slope portion of at least one riverbank, a portion of the rubber dam body contacting with the slope portion 16 is first cut out at a position corresponding to the pipe 20 and anchor bolts 21 embedded in the slope portion and then one end of the pipe 20 is fixed to the rubber dam body through a washer 22 by means of nuts 23.

The port opening of the pipe 20 attached to the rubber dam body is, of course, position in the contact area as described above at the slope portion of the riverbank. Considering that the drain remains in the inside of the rubber dam body (particularly, the pipe is disposed only in the slope portion of the riverbank without laying in the riverbed), it is preferable that the port opening is positioned above an acceptable height of the remaining drain in the rubber dam (i.e. about 10% of the dam height at the inflated state).

FIGS. 13 and 14 illustrate other embodiments of attaching the fluid entrance pipe to the rubber dam body at the slope portion of the riverbank, respectively. In these figures, dotted lines indicate the position of the pipe at the slope portion and a shadowed region is a contact area of the rubber dam body with the slope portion at the inflated state. The region capable of attaching the pipe to the rubber dam is substantially trapezoidal in FIG. 13, and in this case the top end of the rubber dam body is considered to be an end at the downstream side. In FIG. 14, the position of the pipe is further shifted toward the upstream side.

According to the invention, the pipe for supply and discharge of the fluid (or fluid entrance pipe) communicates with the inside of the rubber dam body from the slope portion of at least one riverbank as mentioned above, so that the pipe is not necessary to be laid in the riverbed and hence the securing operation of the rubber dam body to the riverbed is considerably simplified. And also, the drain remaining in the rubber dam body never flows into the pipe. Further, if it is intended to discharge the enclosed fluid from the inside of the rubber dam body, the drain extracting operation becomes unnecessary, and particularly the discharge of the enclosed fluid can be exactly worked even in an emergency such as flood or the like to achieve the complete deflation of the rubber dam.

Even if the drain remains in the inside of the rubber dam body according to the invention, it serves as a cushioning member for the rubber dam body at the deflated state, which mitigates the damage of the rubber dam body due to collision with rolling stones or others. Moreover, the drain can be discharged by a forced-drain means at such a stage that the quantity of the remaining drain reaches to a certain height.

When using the rubber dam body manufactured by the one-piece press molding as shown in FIGS. 2 and 3, the merits of the invention by not laying the pipe in the riverbed are developed effectively.

Preferably, when the fluid entrance pipe communicates with the rubber dam body from the slope portion of the riverbank, it is located in the contact area of the rubber dam body with the slope portion of the riverbank at the inflated state of the rubber dam, so that a forcible stress is not produced on the portion of the pipe even if the change of water level or the back flow of stream occurs. Consequently, the premature failure of the rubber dam body is prevented to considerably improve the durability of the rubber dam body. Moreover, the attachment of the pipe from only the slope portion of the riverbank without laying in the riverbed is particularly effective in elimination of any stress concentration.

The case where the fluid entrance pipe communicates with the inside of the rubber dam body from both the riverbanks will now be described with reference to FIG. 15.

Referring to FIG. 15, the fluid entrance pipe 20 communicates with the rubber dam body 10 from the slope portions 16 of both riverbanks. In this case, each port opening of the pipes 20 is located in the shadowed region of ΔABD shown in FIG. 5 and above the acceptable height of the remaining drain in the rubber dam body. Therefore, no forcible stress is produced on the connected portion between the pipe and the rubber dam body during the inflation of the rubber dam body or due to the change of water flow.

Furthermore, the pipe 20 communicates with a discharge valve 25 located upward at the riverbank. In the illustrated embodiment, one of the pipes 20 is connected to a horizontal pipe 26 laid in the riverbed 15 in order to perform the valve operation at only the side of the riverbank. In any case, the pipe 20 can be considered to extend toward the discharge valve 25 at substantially an upgrade, so that the drain never remains in the course of the pipe.

Figure 1:
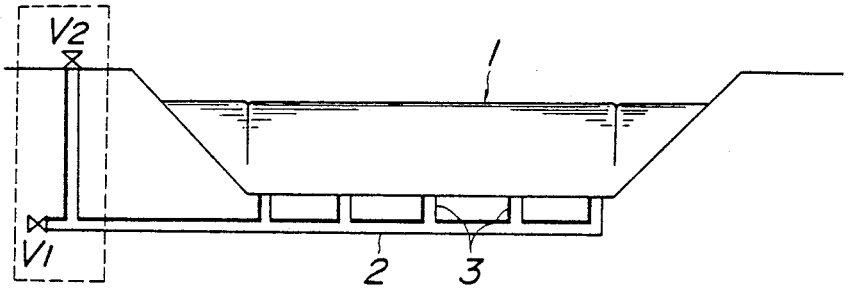
FIG 1 (PRIOR ART)
FIG. 1 is a schematic view of the pipe-line of the conventional rubber dam as previously mentioned.

The inflation and deflation of the rubber dam body 10 using the pipe-line shown in FIG. 15 are performed as follows:

The inflation of the rubber dam body is achieved by pumping a fluid such as air or the like into the inside of the rubber dam body 10 by means of supply equipment 27 such as a blower or the like. When the pipe-line shown in FIG. 15 acts as a pipe for supply and discharge of the fluid, even if drainage remains somewhat in the horizontal pipe 26 during pumping, the drainage is pushed out from the horizontal pipe 26 into the inside of the rubber dam body by the pumped fluid, so that the fluid-supplying operation is not obstructed even when the drainage remains in the horizontal pipe 26. Moreover, in order to efficiently push out any drainage from the horizontal pipe 26 into the inside of the rubber dam body during the pumping of the fluid, it is preferable to use pipe-lines as shown in FIGS. 16 and 17. In FIG. 16, the diameter of the pipe 20' located on the side of the supply equipment 27 is made smaller than the diameter of the opposite pipe 20 to increase the pressure loss during the supply of the fluid. Thus, the pressure in the horizontal pipe 26 is increased to push out any drainage into the inside of the rubber dam body. In FIG. 17, a check valve 28 is arranged in the pipe 20 located on the side of the supply equipment 27. The fluid is supplied into the inside of the rubber dam body 10 through the horizontal pipe 26 and the opposite pipe 20 during the pumping of the fluid, while the enclosed fluid is pulled out through both the pipes 20, 20' during the discharge of the fluid. In any case, when the actuation of the supply equipment 27 is stopped after the completion of inflation, the drainage never returns into the horizontal pipe and the like. On the contrary, when using the conventional pipe-line as shown in FIG. 1, even if drainage remaining in the pipe 2 is pushed out into the inside of the rubber dam by pumping the fluid from the supply equipment, the drainage always returns into the pipe 2 through the conduits 3.

During inflation, the enclosed fluid is condensed by the change of air temperature or the like to produce a drain. Almost all of the drainage is produced by the condensation of the enclosed fluid in the rubber dam from the viewpoint of its volume. According to the invention, the pipe is not opened in the riverbed portion, so that even if drainage is produced inside the rubber dam, it never flows into the pipe from the inside of the rubber dam. On the contrary, in the conventional pipe-line as shown in FIG. 1, the drainage produced inside the rubber dam always remains in the horizontal pipe 2 through the conduits 3.

The inflated rubber dam body is deflated as follows. In this case, it is considered to conduct suction of the enclosed fluid by the actuation of the blower, but the enclosed fluid is usually discharged into atmosphere by the opening of the discharge valve 25. That is, with the opening of the discharge valve 25 the rubber dam body 10 begins to deflate from the approximately central portion toward its lengthwise direction in connection with the water flow, whereby the enclosed fluid is pushed away to the slope portions of both the riverbanks and smoothly discharged through the two pipes 20 and horizontal pipe 26 from the discharge valve 25 into atmosphere. On the contrary, in the conventional pipe-line of FIG. 1, the drainage always remains in the horizontal pipe 2, so that the enclosed fluid cannot be discharged from the inside of the rubber dam until the drainage is extracted completely.

FIG. 18 illustrates an embodiment wherein a drain extracting pipe 29 is arranged in the rubber dam body 10 in order to extract the drainage remaining inside the rubber dam body 10. The drainage extracting pipe 29 may be disposed in any position of the riverbed portion 15. Particularly, when using the rubber dam body manufactured by the one-piece mass molding as previously mentioned, it is preferable that the drainage extracting pipe 29 is located in the riverbed near the toe of the slope portion 16 (shown by point a in FIG. 15) in view of the attaching operation.

A modified embodiment of the flexible plate body as shown in FIG. 3 employs a flexible plate body 10' provided with an auxiliary inflatable chamber 14 having a diameter smaller than that of the main inflatable chamber (or split portion) **10'*a* in order to smoothly perform the discharge of the enclosed fluid. This is shown in FIG. 19. The flexible plate body 10' is secured at its solid flange portion 10'*b* to the riverbed portion and the slope portions of both the riverbanks in the same manner as mentioned above and then a pipe-line as shown in FIG. 20 is attached near the end portion of the flexible plate body 10' at the slope portion 16** of the one riverbank.

That is, pipes 20, 30 for supply and discharge of fluid are airtightly connected to port openings 31, 32 for the main inflatable chamber **10'*a* and auxiliary inflatable chamber 14, respectively. In the illustrated embodiment, the fluid entrance pipe 20 serves as a pipe for supply and discharge of the fluid to the main inflatable chamber 10'*a*, but the pipe 20 may function for only the discharge of the fluid, if necessary, by using another pipe for only the supply of the fluid. In any case, each of the port openings 31 and 32 is located in the shadowed region of ΔABD shown in FIG. 5** and above the acceptable height of the remaining drain.

In FIG. 20, the fluid entrance pipe 20 is connected at its one end to the port opening 31 located in the portion of the flexible plate body 10' secured to the slope portion 16 at the highest end of the inflation height. The other end of the pipe 20 is extended upward at substantially an upgrade and connected to a blower B through valves $b_1$ and $b_2$. Further, between the blower B and the valve $b_2$ a branch pipe 20' is disposed and provided with a valve $b_3$ and a discharge port 33.

A branch pipe 20'' is connected at its one end to the pipe 20 between the valves $b_1$ and $b_2$ and the other end thereof is connected to the blower B through a valve $b_4$. Furthermore, between the blower B and the valve $b_4$ a branch pipe 20''' is disposed and provided with a valve $b_5$ and an intake port 34.

To the branch pipe 20'' is connected an end of the fluid entrance pipe 30 for the auxiliary inflatable chamber 14 through a valve $b_6$.

Moreover, a branch pipe 35 is connected at its one end to the pipe 20 between the port opening 31 and the valve $b_1$ and the other closed end thereof is provided with a float valve 36. This float valve 36 interlocks with a float 38 present in a float chamber 37 arranged just beneath the valve 36 to open and close an opening 35' of the branch pipe 35. The float chamber 37 communicates with a water intake port 39 arranged above the flexible plate body on the upstream side (or downstream side as the case may be) at a position corresponding approximately to a critical water level in order to detect the critical water level during rising of the river due to a flood or the like. That is, when water flows into the float chamber 37 through the water intake port 39 during rising of the river, the float 38 rises with the increase of the water level to push up the float valve 36 upward, whereby the opening 35' of the branch pipe 35 is opened.

The working cycle of the pipe-line shown in FIG. 20 will now be described.

(1) Inflation of flexible plate body 10':

First, the valves $b_3$, $b_4$ and $b_6$ are closed, while the valves $b_1$, $b_2$ and $b_3$ are opened. Then, air is drawn through the intake port 34 by actuation of the blower B and thereafter pumped into the main inflatable chamber 10'a through the valves $b_5$, $b_2$ and $b_1$, the pipe 20 and the port opening 31 to inflate the flexible plate body 10'. After the main inflatable chamber 10'a is filled with air, the actuation of the blower B is stopped and the valves $b_5$, $b_2$ and $b_1$ are closed.

(2) Deflation of flexible plate body 10':

(i) First, the valves $b_3$, $b_1$ and $b_4$ are closed, while the valves $b_5$, $b_2$ and $b_6$ are opened. Then, air is drawn through the intake port 34 by the actuation of the blower B and thereafter pumped into the auxiliary inflatable chamber 14 through the pipe 30 protruding the chamber 14 on the inner wall of the main inflatable chamber 10'a. Next, the valves $b_5$, $b_2$ and $b_6$ are closed, while the valves $b_1$, $b_4$ and $b_3$ are opened. By actuating the blower B, air in the main inflatable chamber 10'a is discharged from the discharge port 33 through the port opening 31, the pipe 20 and valves $b_1$, $b_4$ and $b_3$ into atmosphere, whereby the flexible plate body 10' begins to deflate.

Moreover, the auxiliary inflatable chamber 14 is previously inflated as described above, so that even if the flexible plate body 10' is deflated at any position, the auxiliary inflatable chamber 14 protrudes inside the main inflatable chamber 10'a to form continuous clearance parts 40 as shown in FIG. 21. Therefore, the opposed inner walls of the main inflatable chamber 10'a do not adhere to each other owing to the presence of the protruded auxiliary inflatable chamber 14. Furthermore, the continuous clearance part 40 extends near the port opening 31 along the inflated auxiliary inflatable chamber 14 in the lengthwise direction thereof, so that air remaining in the main inflatable chamber 10'a moves to the part 40 and is completely discharged through the above mentioned discharge line. As a result, abnormal deflation of the flexible plate body 10' is prevented due to the influence of water pressure or the like.

(ii) Automatic deflation by atmospheric discharge

After the main and auxiliary inflatable chambers 10'a and 14 are previously inflated as mentioned above, all of the valves are closed and the flexible plate body 10' is actually worked. If the flow rate of the stream in the river abnormally increases due to flood or the like, the increased water first flows into the float chamber 37 through the water intake port 39. As a result, the float 38 rises to push up the float valve 36, whereby air in the main inflatable chamber 10'a is smoothly discharged into atmosphere through the port opening 31, pipe 20, branch pipe 35 and opening 35'. In this case, complete deflation can be expected by the action of the auxiliary inflatable chamber 14 as mentioned above.

By using the flexible plate body 10' as shown in FIG. 19, complete deflation can be achieved, but it is necessary to perform the supply and discharge of the fluid for the auxiliary inflatable chamber 14, so that the pipeline becomes complicated as shown in FIG. 20. According to the invention, therefore, a protruding member resistent to water pressure extends inside the flexible plate body in its lengthwise direction over at least riverbed portion instead of the auxiliary inflatable chamber. Hence, not only adhesion between the opposed inner walls of the main inflatable chamber is prevented in the deflation of the flexible plate body, but also the pipe-line for supply and discharge of the fluid can be simplified.

For the protruding member, use may be made of member having a rigidity resistant to water pressure and dead weight of flexible plate body with any shapes, an example of which includes hollow bodies, solid bodies and chain bodies each made of rubber, synthetic resin, metal or the like. Such hollow and solid bodies can take any section shape such as a circle, rectangle, polygon and the like.

The protruding member is arranged inside the flexible plate body in its lengthwise direction over at least the riverbed portion when securing the flexible plate body to the riverbed and slope portions of both the riverbanks. In this case, at least one row of the protruding member extends in the lengthwise direction of the flexible plate body as a continuous body or a discontinuous body (block body). Particularly, it is preferable to extend the protruding member near the port opening for the fluid entrance pipe. If necessary, the protruding member may be adhered and fixed to the inner wall of the main inflatable chamber inside the flexible plate body.

When using a chain body such as metal chain and the like, a solid rod, a solid body prepared by filling a hollow portion of a flexible hose with a fluidizable material capable of solidifying at room temperature, or a plurality of discontinuous hollow bodies as the protruding member, if such a protruding member is extended inside the main inflatable chamber 10a of the flexible plate body 10 as shown in FIG. 2 along its lengthwise direction over approximately a widthwise region of the river, it is sufficient to use a pipe-line for supply and discharge of the fluid as shown in FIG. 22. In this figure, symbols $B_1$ and $B_2$ are valves, symbol E is an ejector, symbol P an air compressor or pump, and numeral 41 a pipe for connecting a safety device S to the inside of the flexible plate body 10. Although the safety device S is not shown in its mechanism, there may be used a device utilizing the water level difference, a device utilizing the mechanical elasticity of rubber or a spring and the like. In the pipe-line of FIG. 22, the fluid entrance pipe for the auxiliary inflatable chamber can be omitted, so that this pipe-line is more simplified as compared with the pipe-line shown in FIG. 20.

When the flexible plate body 10 is inflated by using the pipeline of FIG. 22, the valve $B_1$ is first opened, while the valve $B_2$ is closed. Then, a fluid such as air, water or the like is pumped into the inside of the flexible plate body 10 through the pipe 20 by the actuation of the air compressor or pump P. In this case, even if the internal pressure of the flexible plate body exceeds a proper pressure by mistakenly pumping an excessive amount of the fluid into the flexible plate body, the excessive internal pressure is released by the actuation of the safety device S because the internal pressure of the flexible plate body is exactly transmitted to the safety device S through the pipe 41. That is, the breakage of the flexible plate body is prevented by the actuation of the safety device S.

In order to deflate the inflated flexible plate body as mentioned above, the enclosed fluid may be discharged into atmosphere only by opening the valve $B_2$. Preferably, the valves $B_1$ and $B_2$ are opened and the pump P is actuated, whereby the fluid filled in the main inflatable chamber is forcedly discharged from the valve $B_2$ by the action of the ejector E. Thus, the inflated flexible plate body 10 begins to promptly deflate from that portion of the main inflatable chamber unbalanced in relation between the internal pressure of the main inflatable chamber and the water pressure applied externally.

When the port opening for the fluid entrance pipe is arranged only at the one end of the flexible plate body as shown in FIG. 22, if the auxiliary inflatable chamber or the protruding member does not extend inside the flexible plate body as in the conventional rubber dam, there is a problem of causing abnormal deflation because when the vicinity of middle portion of the flexible plate body begins to deflate, the opposed inner walls of the main inflatable chamber adhere to each other at that deflated portion and hence it is impossible to discharge the fluid in a space between the deflated portion and the other end containing no port opening.

On the other hand, according to the illustrated embodiment, even if the flexible plate body is deflated from any position, the presence of the protruding member extending inside the flexible plate body along its lengthwise direction over approximately a widthwise region of the river prevents the adhesion between the opposed inner walls of the main inflatable chamber to form substantially continuous clearance parts along the protruding member in its lengthwise direction in the deflation of the flexible plate body. As a result, the opposed inner walls of the main inflatable chamber are not closely adhered to each other by the water pressure. Furthermore, the fluid remaining inside the flexible plate body is moved along the clearance parts and discharged through the port opening into atmosphere, whereby the flexible plate body is completely deflated.

However, when the chain body, solid body or the like is used as the protruding member, if the height of the remaining drain becomes higher than the height of the protruding member, the clearance parts extending along the protruding member are filled with the remaining drainage during the deflation of the flexible plate body. As a result, it is difficult to smoothly discharge the enclosed fluid and there may be caused incomplete deflation of the flexible plate body.

In the preferred embodiment of the invention, therefore, at least one hollow body having a continuous hollow part in its lengthwise direction (hereinafter referred to as a continuous hollow body) is used as the protruding member, an end of which is opened upward inside the flexible plate body. Such a continuous hollow body can take any sectional shape such as circle, rectangle, polygon and the like as well as a body of ⊐-shaped section forming a hollow part together with the inner wall of the flexible plate body. Preferably, the continuous hollow body is made of a flexible material such as rubbery elastomer or the like.

The continuous hollow body may be a wire braided hose 42 as shown in FIGS. 23 and 24. A composite pipe obtained by connecting flexible pipes of rubbery elastomer each extending along the slope portion of the riverbank to both ends of a metal pipe extending along the riverbed, a metal pipe assembly obtained by connecting metal pipes with a flexible pipe at a position near the toe of the slope portion and the like may also be used. Also, a hollow body 43 as shown in FIG. 25 may be employed wherein both the lengthwise sides are cut out into a semi-circular sectional shape. In the latter case, the area of the clearance part can further be increased in the lengthwise direction.

In the illustrated embodiment of FIG. 23, two continuous hollow bodies (or wire braided hoses) 42 extend side by side along the lengthwise direction of the flexible plate body 10, but at leat one continuous hollow body (or protruding member) may be extended at any position inside the flexible plate body in accordance with the use conditions of the river to be dammed. In any case, it is important that at least one end of the continuous hollow body is opened upward inside the flexible plate body along the slope portion of the riverbank. The opening end of the continuous hollow body must be positioned above the acceptable height of the remaining drainage because moisture contained in the fluid such as air or the like to be supplied into the flexible plate body is condensed to form drainage remaining in the bottom of the flexible plate body.

When the wire braided hose 42 is attached as a protruding member to the flexible plate body or rubber dam body 10 shown in FIG. 2, the open end portion of the flexible plate body 10 is first positioned on the riverbed 15 and slope portions 16 of both the riverbanks toward the upstream side of the river. Then, the split portion 10*a* is opened from the open end portion and the wire braided hose 42 is disposed on the upper surface of the bottom side of the split portion 10*a* along the lengthwise direction of the flexible plate body 10. Thereafter, the wire braided hose 42 is fixed to the inner wall of the flexible plate body by an adhesive or a physical fitting means. In this case, a convas such as rubberized canvas or the like is wound around the hose 42 at proper positions and then fixed to the inner wall of the flexible plate body with an adhesive. The fixing of the hose may be performed by using fixing members as shown in FIGS. 26–28.

A fixing member 44 shown in FIG. 26*a* is a rubber block body. A plurality of the fixing members 44 are fixed to the inner wall of the flexible plate body 10 at predetermined positions with an adhesive and then the hose 42 is fitted into a hollow part 44*a* of the fixing member 44 as shown in FIG. 26*b*. A fixing member shown in FIG. 27 is a hollow rubbery block body 45 provided at its one side with a solid flange portion 45*a*, through a hollow part 45*b* of which is passed the hose 42. This block body 45 is fixed at the solid flange portion 45*a* to the flexible plate body 10 by means of bolts or anchor bolts previously embedded in the riverbed and nuts. As a modified embodiment of FIG. 27, a hollow rubbery block body has no flange portion 45*a* and may be fixed to the inner wall of the flexible plate body with an adhesive in the same manner as described in FIG. 26. A fixing member shown in FIG. 28 is a steel block body 46 of ⊐-shaped section. Since this block body 46 itself is fairly heavier, the hose 42 is merely covered by the block body 46. Moreover, the block body 46 may also be fixed by means of bolts and nuts or an adhesive in the same manner as described above. In any case, these fixing members serve to prevent the floating off of the continuous hollow body when the drain or the like remains in the inside of the flexible plate body. When using a heavy continuous hollow body such as metal pipe or the like, moving or floating off of such continuous hollow body does not occur, so that the illustrated fixing members can be omitted. Moreover, when a flexible pipe extends as a part of the continuous hollow body along the slope portion of the riverbank, it is necessary to fix the flexible pipe at a proper position by means of any fixing member as shown in FIGS. 26–28.

In the securing operation of the flexible plate body to the riverbed, if a riverbed portion constitutes a part of the main inflatable chamber of the rubber dam body, the continuous hollow body may extend on a concrete surface of that riverbed portion.

Furthermore, the fixing of the continuous hollow body may be carried out locally at proper positions or over a whole length of the rubber dam body along its lengthwise direction. Alternatively, only the end of the continuous hollow body may be fixed to the inner wall of the flexible plate body 10 by using a fixing canvas as shown in FIG. 29 or a fixing member 48 as shown in FIG. 30 together with bolts and nuts.

As previously mentioned, at least one end of the continuous hollow body is opened upward from the riverbed along the slope portion of the riverbank in the rubber dam body. The other end of the continuous hollow body terminates near the port opening for the fluid entrance pipe 20 as shown in FIG. 24 or may be terminated upward over the port opening as shown in FIG. 29. Alternatively, the other end of the continuous hollow body may be positioned outside the flexible plate body by passing through the fluid entrance pipe 20 or without passing through the fluid entrance pipe.

In the illustrated embodiments, separate protruding member is extended in the inside of the flexible plate body 10 along its lengthwise direction, but the protruding member may be integrally formed in the one-piece press molding of the flexible plate body.

After the protruding member is arranged inside the flexible plate body as mentioned above, holes (not shown) pierced in the open end portion of the flexible plate body 10 receive respective anchor bolts 18 previously embedded in the riverbed 15. Then, the open end portion of the flexible plate body 10 is airtightly secured to the riverbed 15 through an elongated and perforated keep member 17 by means of nuts 19. When securing the flexible plate body to the slope portion of the riverbank, the open end portion at both side ends of the flexible plate body is obliquely cut at a predetermined angle toward a downstream side of the river and then the thus cut open end portion is airtightly secured to each slope portion 16 of both riverbanks in the same manner as described above by means of anchor bolts 18, keep member 17 and nuts 19.

The flexible plate body 10 secured to the riverbed and riverbanks is arranged the fluid entrance pipe 20 in the same manner as described in FIGS. 11 and 12.

A dot-dash line shown in FIG. 23 shows the inflated state of the flexible plate body 10 by supplying a fluid such as air, water or the like through the fluid entrance pipe 20 (see FIG. 24). In this case, the rubber dam body is not significantly subjected to damage by driftwood and the like owing to the thicker gauge of the rubber sheets 12, 13 constituting the rubber dam body. Further a joint portion 10*b* of the plate body acts as a throat, so that vibration of the rubber dam body and hence fatigue phenomon accompanied therewith are not caused. As a result, the rubber dam body develops a stable damming effect.

When the rubber dam body is changed from the inflated state shown by dot-dash line into the deflated state shown by solid line in FIG. 23 by the discharge of the enclosed fluid, since the wire braided hose 42 resists water pressure and the dead weight of the rubber dam body is extended inside the rubber dam body along its lengthwise direction over a whole length, continuous clearance parts 40 are formed along the hose 42 in its lengthwise direction in addition to the hollow part of the hose 42. Therefore, even when the fluid entrance pipe is attached only to the slope portion of the riverbank, not only is adhesion between the opposed inner walls of the flexible plate body prevented, but also the fluid in the portion of the flexible plate body near the slope portion of the opposite river bank is rapidly discharged through the hollow part of the hose and the clearance parts extending along the hose. As a result, even if the rubber dam body begins to deflate from any position, the enclosed fluid never remains in the inside of the rubber dam body in the course of the deflation, so that the rubber dam body becomes always flat in the complete deflated state as shown in FIG. 23. Moreover, when the riverbed portion securing the rubber dam body is cut out in accordance with the deflated shape of the rubber dam body as shown in FIG. 23, the upper surface of the rubber dam body is approximately equal to the surface of the riverbed. This serves to prevent the damage of the rubber dam body without obstructing the water flow.

As mentioned above, when the protruding member resistant to water pressure extends inside the rubber dam body along its lengthwise direction over approximately a whole length, the adhesion between the opposed inner walls of the rubber dam body due to water pressure and dead weight of the dam body is prevented in the deflation operation and also the movement of the enclosed fluid is permitted by the continuous clearance parts extending along the protruding member in its lengthwise direction, hence the complete deflation of the rubber dam body can always be expected without causing abnormal deflation. Further, the port opening for the fluid entrance pipe is sufficient to be disposed only at one position in the slope portion of the riverbank without laying the pipe in the riverbed. Thus, the workability and the inflation and deflation operabilities are excellent.

Particularly, when using the continuous hollow body as the protruding member, even if the continuous clearance parts extending along the protruding member are filled with the drainage remaining in the inside of the rubber dam body, the enclosed fluid is smoothly discharged through the hollow part of the continuous hollow body. This occurs because the end of the continuous hollow body is opened upward above the acceptable height of the remaining drain on the slope portion of the riverbank. As a result, complete deflation of the rubber dam body can always be achieved.

In the above illustrated embodiments, deflation of the rubber dam body is performed by discharging the enclosed fluid into atmosphere by opening of the valve or by forced-draining with vacuum pump. In any case, the deflation of the rubber dam body occurs by the pushing down by water pressure, so that the time required for the deflation of the rubber dam is fairly long.

In order to shorten the deflating time of the rubber dam body, according to one preferred embodiment of the invention, an elastic member 50 as shown in FIG. 31 is arranged inside of the rubber dam body.

That is, when the flexible plate body 10 is secured to the riverbed 15 as shown in FIG. 31, the open end portion of the flexible plate body 10 is first positioned on a riverbed 15 and slope portions 16 of both riverbanks toward an upstream side of a river. Then, an upper split portion 10*a* of the flexible plate body 10 is opened upward and the elastic member 50 having a length equal to or slightly smaller than the deflated width of the flexible plate body is arranged on the upper surface of the lower split portion. In this case, the elastic member 50 extends inside the flexible plate body at a proper position in the widthwise direction of the river, but may be positioned over the whole width of the river, if necessary.

For the elastic element 50, use may be made of elements with any shapes having a restoring force without causing plastic deformation, such as a metal, a spring steel, a plastic, FRP, hard rubber or the like. Among them, a plate body of such material is preferably used, but a plurality of elastic elements having a circular section such as steel cords, piano wires or the like may also be used side by side.

After the elastic element 50 of a plate shape as shown in FIG. 31 is arranged at a proper position inside the flieible plate body and the split portion 10*a* is closed, the flexible plate body 10 is airtightly secured to the riverbed 15. In this case, holes (not shown) pierced in the open end portion of the flexible plate body and the end portion of the elastic element receive respective anchor bolts 18 previously embedded in the riverbed 15. Thereafter the securing operation is performed through the keep member 17 by means of nuts 19.

In securing the flexible plate body 10 to the slope portion 16 of the riverbank, the open end portion at both side ends of the flexible plate body is obliquely cut at a predetermined angle toward a downstream side of the river and then the thus cut open end portion is airtightly secured to the slope portion of the riverbank by using the anchor bolts, keep member and nuts in the same manner as described above.

In the flexible plate body 10 secured to the riverbed 15 and the slope portions 16 of both riverbanks, the fluid entrance pipe is arranged in the same manner as described in FIGS. 11 and 12.

FIGS. 32 and 33 show the inflated state of the flexible plate body 10 by the supply of a fluid such as air, water or the like. In this case, the elastic element 50 deforms in compliance with the inflated shape of the flexible plate body. In such an inflated state, the rubber dam body is not significantly subjected to damage by driftwood and the like owing to the thicker gauge of the rubber sheets 12, 13 constituting the rubber dam body. Further, a joint portion 10*b* between the rubber sheets 12, 13 of the plate body acts as a throat, so that vibration of the rubber dam body and hence the fatigue phenomenon accompanied therewith are not caused. As a result, the rubber dam body develops a stable damming effect.

When the fluid filling the main inflatable chamber 10*a* is discharged in the inflated state of FIGS. 32 and 33, the rubber dam body 10 begins to deflate under the influence of water pressure or the like. In this case, deflation is immediately started from the position of the elastic element 50 arranged inside the main inflatable chamber 10*a* by the restoring force of the elastic element, whereby the time required for the complete deflation is considerably shortened. Particularly, when the elastic member 50 is arranged near the slope portion of the riverbank opposite to the riverbank including the fluid entrance pipe 20 as shown in FIG. 33, the rubber dam body 10 begins to deflate from the position of the elastic element 50 arranged therein at an initial stage of discharging the enclosed fluid. As a result, the fluid in the main inflatable chamber 10*a* is gradually pushed away toward the fluid entrance pipe 20, whereby the rubber dam body 10 is successively deflated in a direction as shown by an arrow G in FIG. 34. Moreover, when the restoring force applied to the rubber dam body is successively changed in the lengthwise direction of the dam body, for instance, by sparsely arranging the elastic elements 50 toward the fluid entrance pipe 20, the successive deflation of the rubber dam body as shown in FIG. 34 is achieved more rapidly.

In any case, when the elastic element 50 is arranged at such a position as shown in FIG. 33, the clogging of the port opening for the fluid entrance pipe 20 is prevented in the deflation of the rubber dam body, so that the rubber dam body is completely deflated without causing abnormal deflation. Furthermore, the laying work in the riverbed is unnecessary, so that the workability on location becomes easier.

In the illustrated embodiment, a single elastic plate is used as the elastic member 50, but is not intended as limitation of this invention. For instance, a plurality of elastic battens having a very narrow width or a plurality of elastic members having a circular section may be used.

Furthermore, the elastic member as shown in FIG. 31 is secured together with the open end portion of the flexible plate body to the riverbed by means of anchor bolts. The elastic member 50 may also be embedded in the rubber sheet 13 in the one-piece press molding of the flexible plate body 10. Alternatively, the elastic member 50 may be adhered to the upper surface of the lower split portion 10*a* or to the outer surface of the split portion facing the riverbed by vulcanization or with an adhesive.

Moreover, the elastic member has a size sufficient to produce an elastic force (or restoring force) in the deflation of the rubber dam body after it is positioned in at least a part inside the main inflatable chamber and then deformed in accordance with the inflated state of the main inflatable chamber.

The elastic member may be located at any proper position in the widthwise direction of the river. When the fluid entrance pipe is disposed on the slope portion of the one riverbank as shown in FIG. 33, it is preferable that the elastic element be located near the slope portion of the opposite riverbank to deflate as a last step the portion of the rubber dam body near the fluid entrance pipe. When the elastic element is located near the slope portion of the riverbank, however, water flowing over the rubber dam body swirls at the downstream side in the beginning of the deflation sequence. As a result, earth and sand are apt to be accumulated between the rubber dam body and the riverbed at the downstream side. Considering this fact, it is most preferable that the elastic member be located at substantially a middle position of the rubber dam body in the widthwise direction of the river. This prevents the accumulation of earth and sand at the downstream side and the adjustment of the dam height becomes easy. In any case, the continuous hollow body as shown in FIG. 23 or the like is used in order to prevent the abnormal deflation of the rubber dam body.

When the rubber dam body as shown in FIG. 2 is deflated by discharging the enclosed fluid without using the elastic member, the starting position for deflation is not constant, so that there may be the following problems.

(1) Since the starting position for deflation is not defined, it is required to lay a pipe for supply and discharge of a fluid in the riverbed securing the rubber dam body. As a result, the laying operation is complicated and takes a long time.

(2) When the rubber dam body is set up in rivers or the like apt to cause the accumulation of earth and sand, if the rubber dam body begins to deflate from the position near the slope portion of the riverbank, the earth and sand are accumulated at the downstream side of that deflated portion. As a result, the rubber dam body is incompletely deflated even when continuing the discharge of the fluid, so that the function inherent to the rubber dam body or the free inflation-deflation operation is impaired.

According to the invention, therefore, a dam height at the inflated state of the rubber dam body by the supply of the fluid is lowered in at least a position along the widthwise direction of the river and is always a starting position for deflation.

The position of lowering the dam height is properly determined in accordance with use conditions of the rubber dam body. For instance, it is desirable to set the stream lead of the river in a widthwise center thereof in view of hydraulics, which is achieved by lowering the dam height at the central portion of the rubber dam body in the widthwise direction of the river. It is also desirable that the port opening for the fluid entrance pipe be located on the slope portion of at least one riverbank except the riverbed in view of the omission of the complicated laying in the riverbed. In the latter case, the dam height is lowered at a position near the slope portion of the opposite riverbank in order to smoothly perform the supply and discharge of the fluid.

Various embodiments for lowering the dam height in at least a position of the rubber dam body along the widthwise direction of the river will now be described.

Figure 35:
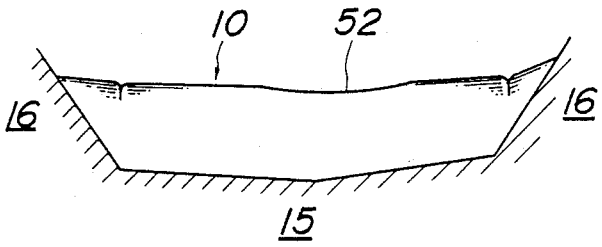

In a first embodiment as shown in FIG. 35, the middle portion of the riverbed 15 in the widthwise direction of the river is previously dug down and thereafter the flexible plate body 10 is secured to the riverbed 15. Thus, the middle portion 52 of the flexible plate body 10 is lowered as compared with the other portion of the flexible plate body.

Figure 36:
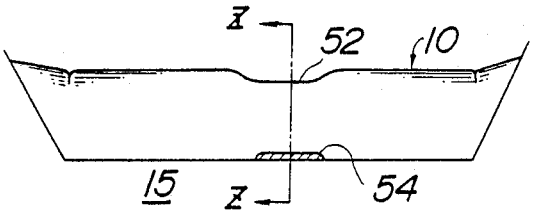
Figure 37:
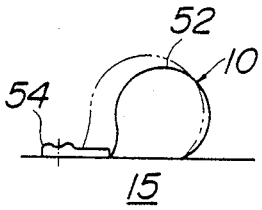

In a second embodiment as shown in FIG. 36, the dam height is lowered by holding down the secured portion of the flexible plate body 10 to the riverbed 15 near the widthwise center of the river with a constraining member 54. FIG. 37 is a transverse sectional view taken along a line Z-Z of FIG. 36. Moreover, the constraining member 54 may be made of an elongated and perforated keep member used for securing the flexible plate body to the riverbed, provided that the width is made wider only at the central portion in the lengthwise direction.

Figure 38:
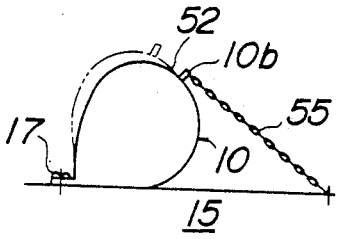

FIG. 38 is a schematically transverse sectional view of a third embodiment, wherein the dam height of the middle portion 52 in the widthwise direction of the river is lowered by pulling and constraining a part of the flexible plate body with a chain or rope 55 toward the downstream side of the river. In this case, the use of the flexible plate body 10, 10' as shown in FIGS. 2 and 3 is preferable because the chain or rope is easily attached to the joint part **10*b*** of the flexible plate body. There is no problem relating to the leakage of the enclosed fluid when compared with the case of shaping the rubbery sheet material into a closed bag on the working site.

Figure 39:
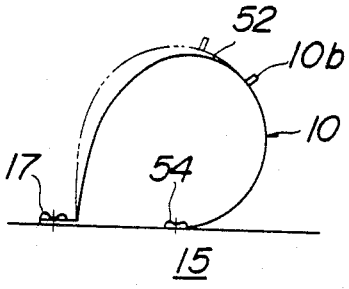

FIG. 39 is a schematically transverse sectional view of a fourth embodiment, wherein the dam height of the middle portion 52 is lowered by disposing the constraining member 54 inside the flexible plate body 10 at the widthwise center of the river. Moreover, the constraining member 54 is the same as used in FIG. 36.

In a fifth embodiment, the dam height of the middle portion 52 is lowered by the restoring force of the elastic member 50 arranged inside the flexible plate body 10 as shown in FIG. 31. Thus, the use of the elastic member 50 is particularly preferable because it serves not only to lower the dam height, but also to shorten the deflation time.

Figure 40:
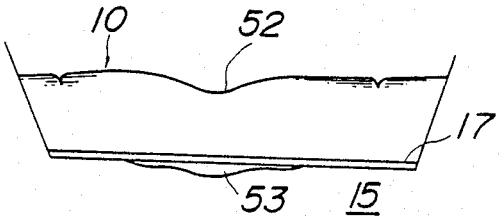

FIG. 40 shows a sixth embodiment viewed from the upstream side, wherein the dam height of the middle portion 52 is lowered by protruding a portion 53 of the open end portion of the flexible plate body 10 from the keep member 17 at the widthwise center of the river. This secures the flexible plate body 10 to the riverbed 15 in such a manner that the peripheral length of the middle portion is shorter than that of the other portion.

Figure 41:
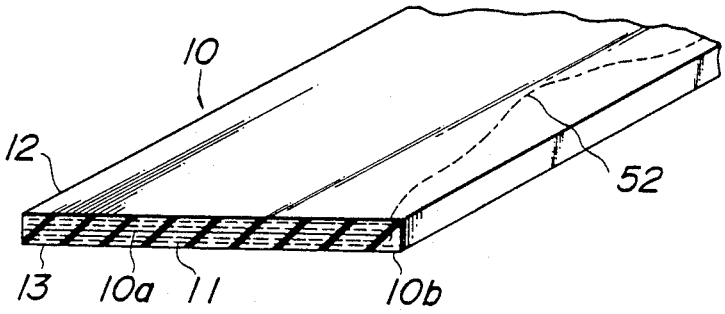

FIG. 41 is a perspective view of a modified embodiment of FIG. 40, wherein a part of the joint portion **10*b* (the middle portion 52 in the illustrated embodiment) is further extended toward the open end portion of the flexible plate body 10** to shorten the peripheral length of that part in the inflated state.

Figure 42:
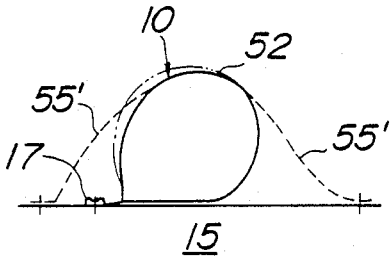

FIG. 42 is a schematically transverse sectional view of a seventh embodiment, wherein a part of the flexible plate body 10 (the middle portion 52 in the illustrated embodiment) is constrained by extending a rope, belt, chain or the like (55') over the rubber dam body and fixing both ends thereof at the upstream and downstream sides.

Figure 43:
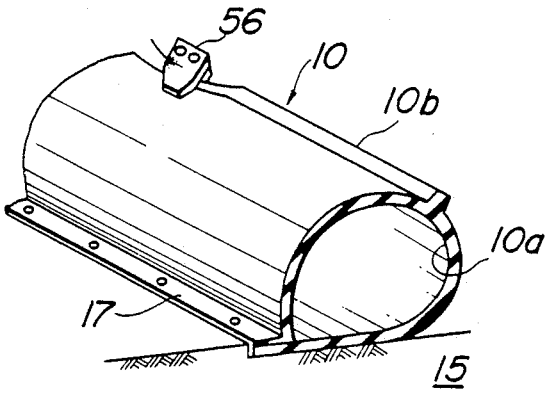
Figure 44:
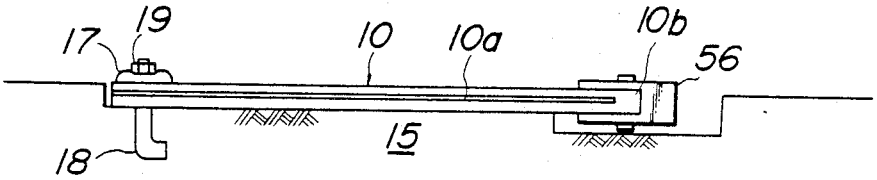

It is possible to lower the dam height by attaching a weight to a part of the rubber dam body. In this case, however, it is necessary to use a fairly heavier weight. In an eighth embodiment as shown in FIG. 43, a clip fitting member 56 is used instead of the weight. That is, a part of the main inflatable chamber **10*a* is constrained over the joint portion 10*b* with the clip fitting member 56 to shorten the peripheral length of the flexible plate body 10 at that constrained portion, whereby the dam height is lowered at the predetermined position. FIG. 44 is a sectional view illustrating the deflated state of the flexible plate body 10 shown in FIG. 43. The longer the constrained length of the main inflated chaber 10*a*, the shorter the peripheral length of the flexible plate body 10 at that constrained portion. In the attachment of the clip fitting member 56 to the flexible plate body, the use of the flexible plate bodies 10, 10' as shown in FIGS. 2** and 3 is preferable because the clip fitting member 56 can be secured to the joint portion 10*b* by means of bolts and nuts as shown in FIG. 44. Also, there is no problem relating to the leakage of the enclosed fluid or the like as compared with the case of shaping the rubbery sheet material into a closed bag on the working site.

Figure 45:
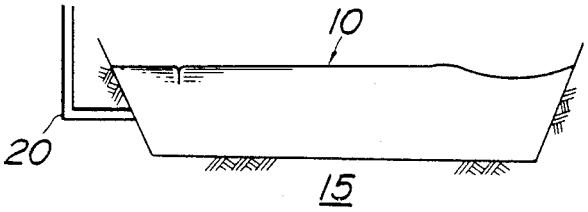

FIG. 45 is a ninth embodiment viewed from the downstream side, wherein the dam height is lowered near the slope portion of the riverbank in any of the techniques as mentioned above. In this case, the complete deflation of the rubber dam body can be achieved only by disposing the fluid entrance pipe 20 to the slope portion of the opposite riverbank as shown in FIG. 45.

As described above, when the dam height in the inflated state of the rubber dam body is lowered in at least a position along the widthwise direction of the river, the inflated rubber dam body begins to deflate from that lowered position during discharge of the enclosed fluid. Hence, the starting position for deflation is always settled. Furthermore, there are the following merits:

(1) When the dam height is lowered in the middle portion of the rubber dam body in the widthwise direction of the river, the stream lead of the river always locates in the widthwise center thereof. Thus the accumulation of earth and sand is not biased at the downstream side of the rubber dam body and also the adjustment of the dam height is easy. That is, the lowering of the dam height at the middle position in the widthwise direction of the river is favorable in view of hydraulics.

(2) When the dam height is lowered at a position near the slope portion of the riverbank, that position is a starting position for deflation, so that the complicated laying work in the riverbed and the use of the protruding member are not needed. Consequently the working operation is simplified.

Moreover, the position of the lowering the dam height in the inflated state is not limited to the middle position in the widthwise direction of the river and the position near the slope portion of the riverbank as described above. It can be properly selected in accordance with the structure of the river, the construction of the riverbed portion and the like.

When using the pipe-line for supply and discharge of the fluid as shown in FIG. 20, if the water level of the river abnormally rises due to a flood or the like, flood damage can be prevented by opening the float valve 36 to deflate the rubber dam body 10'. However, the deflation of the rubber dam body 10' occurs rapidly, so that there is a risk of producing a step-wave at the downstream side of the rubber dam body. Furthermore, all of the dammed water flows out toward the downstream side by complete deflation, so that reinflation of the rubber dam body for damming water takes a long time. Therefore, a simple pipe-line as shown in FIG. 46 is employed to automatically adjust the dam height of the rubber dam body, whereby the rapid deflation of the rubber dam body or the like can be prevented.

In FIG. 46, the rubber dam body 10 secured to the riverbed 15 and slope portions 16 of both the riverbanks by means of anchor bolts, keep member and nut communicates with supply and discharge means (not shown) through the fluid entrance pipe 20. Moreover, numeral 60 is a bored portion in a housing built on the riverbank and number 61 is a water conduit for connecting the bored portion to the river.

In FIG. 47 is shown the detail of the pipe-line shown in FIG. 46. Inside the rubber dam body 10 are arranged two protruding members (or continuous hollow bodies as shown in FIG. 23), serving to uniformly and completely discharge the enclosed fluid, and a drain extracting pipe 29 (see FIG. 18) serving to discharge the remaining drain from the inside of the rubber dam body 10 to the riverbed at the downstream side.

The fluid entrance pipe 20 is connected to a supply 66 and a discharge 67 through a supply pipe 64 and a discharge pipe 65, respectively. The supply 66 comprises a filter 66*a*, a blower 66*b* and a prime mover 66*c* driving the blower 66*b*, and is connected to the supply pipe 64 through a flexible pipe coupling 68. The discharge 67 of the illustrated embodiment comprises a manual on-off valve 67*a*. In this figure, numerals 69 and 70 are a supply valve and a pressure gauge arranged in the supply pipe 64, respectively.

Further, a discharge pipe 71 preferably having a smaller diameter branches from the fluid entrance pipe 20. A lever float valve 72 acting as a discharge valve is disposed in the middle portion or open end portion of the small discharge pipe 71. The lever float valve 72 is positioned in such a manner that the working water level of the valve 72 is a predetermined water level for the deflation of the rubber dam body.

As shown in FIG. 48, the lever float valve 72 comprises a float 72*a*, a lever 72*c* connecting the float 72*a* to a link mechanism 72*b*, a valve element 72*f* actuated by a mid-lever 72*e* pivoting with respect to a valve body 72*d* of the link mechanism 72*b*, and a seat packing 72*g* secured to the valve element 72*f* and closing or separating to a valve seat of the valve body 72*d*.

If the float 72*a* rises with the rise of water level over the contemplated water level for deflation, the valve element 72*f* also rises by the actuation of the link mechanism 72*b*. As a result the seat packing 72*g* is separated from the valve seat. Inversely, when the water level drops from the contemplated water level, the seat packing 72*g* is closed to the valve seat by the descending of the float 72*a*.

In the lever float valve 72 of the above structure, when the float 72*a* and the lever 72*c* are made sufficiently lighter in the weight in connection with a pressure receiving area of the seat packing 72*g*, the rise of the internal pressure in the rubber dam body can separate the seat packing 72*g* from the valve seat. In this case, therefore, the lever float valve 72 also acts as a safety valve.

In FIG. 47, numerals 73 and 74 are a check valve and a flexible pipe coupling disposed in the fluid entrance pipe 20, respectively.

The operation of the pipe-line shown in FIG. 47 will be described below.

In order to inflate the rubber dam body 10, the valve of the drain extracting pipe 29 and the manual on-off valve 67*a* are first closed, while a fluid such as air, water or the like (air in the illustrated embodiment) is supplied into the inside of the rubber dam body 10 from the supply 66 through the supply pipe 64 and fluid entrance pipe 20. In this case, the fluid entrance pipe 20 acts as a supply pipe. During the supplying of air, the internal pressure of the rubber dam body is monitored by the pressure gauge 70. When the pressure gauge 70 indicates a value corresponding to about a head pressure for rubber dam, the operation of the supply 66 is stopped.

The thus inflated rubber dam body dams a predetermined volume of water at its upstream side. If the water level dammed at the upstream side reaches a position L corresponding to the predetermined water level due to the increase of the flowing water, the lever float valve 72 is actuated as a discharge valve to discharge the fluid (air) in the rubber dam body from the small discharge pipe 71 into atmosphere. In this case, the fluid entrance pipe 20 acts as a discharge pipe.

The fluid in the rubber dam body is gradually discharged through the small discharge pipe 71 based on the actuation of the lever float valve 72, so that the discharge of the dammed water to the downstream side is very gentle and there is no fear of producing a step-wave at the downstream side.

When the water level drops below the comtemplated water level by the discharge of the dammed water before the complete discharge of the fluid inside the rubber dam body, the small discharge pipe 71 is closed by the lever float valve 72. As a result, the damming of a particular volume by the rubber dam body is further continued. Therefore, it is very easy for the rubber dam body to be reinflated to the predetermined dam height by supply of the fluid, if necessary.

On the other hand, when the water level abruptly rises due to the flood or the like, if the discharge of the enclosed fluid through the small discharge pipe 71 is not sufficient, the manual on-off valve 67*a* is further opened to discharge the enclosed fluid through the large discharge pipe 65. As a result, the rubber dam body 10 is deflated rapidly and completely and hence all of the dammed water flows away toward the downstream side. In this case, the manual on-off valve 67*a* is opened after the dam height of the rubber dam body 10 is lowered to a certain extent by opening the lever float valve 72, whereby the occurrence of a step-wave can be removed surely.

Figure 49:
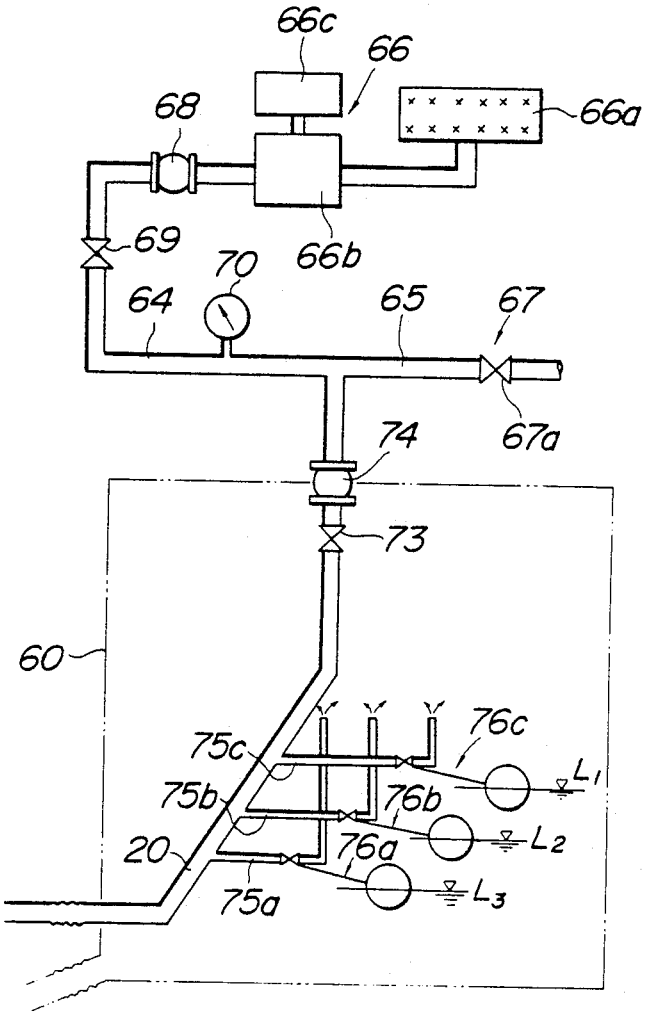

FIG. 49 shows a first modified embodiment of the pipe-line shown in FIG. 47, wherein a plurality of lever float valves are arranged at positions corresponding to different contemplated water levels and the discharge means is the same manual on-off valve 67*a* as used in the previous illustrated embodiment in order to rapidly deflate the rubber dam body in case of emergency.

As apparent from FIG. 49, three small discharge pipes 75*a*, 75*b* and 75*c* branch from the fluid entrance pipe 20 and are provided with respective lever float valves 76*a*, 76*b* and 76*c*, each having the same function as described in FIG. 48. Each of these lever float valves 76*a*, 76*b* and 76*c* is positioned to operate at different predetermined water levels.

According to the pipe-line of FIG. 49, when the water level rises to a first predetermined water level $L_3$, only the lever float valve 76*a* is opened to conduct very slow discharge of the enclosed fluid. As a result, the deflation of the rubber dam body proceeds gently. Then, when the water level reaches to a second predetermined water level $L_2$, the lever float valves 76*a* and 76*b* are opened to advance the deflation of the rubber dam body at a relatively fast rate. If the water level rises to a third predetermined water level $L_3$, all of the three lever float valves 76*a*, 76*b* and 76*c* are opened to promote the deflation of the rubber dam body at a fairly fast rate. In other words, the higher the rising water level or the greater the danger, the faster the deflation rate of the rubber dam body.

In this embodiment, the discharge of the enclosed fluid is performed through the small discharge pipes 75*a*, 75*b* and 75*c* by the successive opening of the lever float valves 76*a*, 76*b* and 76*c*, so that the occurrence of a step-wave due to the rapid deflation of the rubber dam body can be satisfactorily prevented. Further, when any of the lever float valves is closed by dropping of water level, the deflation of the rubber dam body is stopped to dam a particular volume of water. Hence, the reinflation of the rubber dam body to the predetermined dam height can easily be achieved in a shorter time.

In the illustrated embodiment of FIG. 49, the contemplated critical water level for deflation is selected at a position $L_1$ and the lever float valve 76*c* is worked as a main discharge valve, so that the deflation of the rubber dam body is realized at a slow but proper speed.

Figure 50:
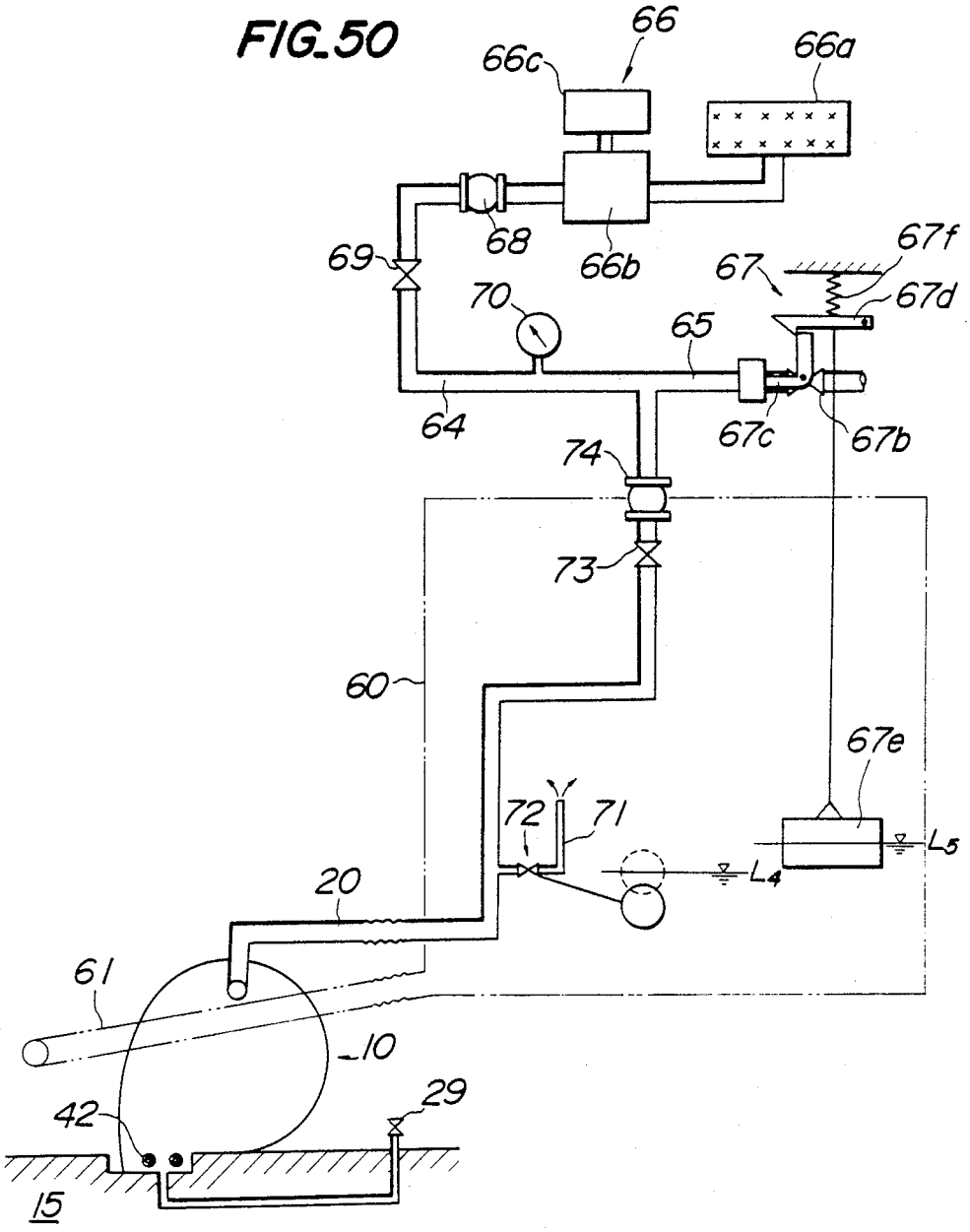

FIG. 50 is a second modified embodiment of the pipeline shown in FIG. 47. In this case, the discharge 67 comprises a main discharge valve 67*b*, a crank member 67*c* integrally united with a valve body of the main discharge valve 67*b* and giving a turning moment to the valve body, a lever 67*d* engageable with the crank member 67*c* for maintaining the crank member at a closed position of the valve body, a float 67*e* pivoting the lever 67*d*, and a spring 67*e*.

In the small discharge pipe 71 branching from the fluid entrance pipe 20 the same lever float valve 72 as described in FIG. 47 is arranged. The lever float valve 72 is positioned in such a manner that the operating water level $L_4$ is sufficiently lower than the operating water level of the float 67*d* or the contemplated water level for deflation $L_5$, whereby the rapid deflation of the rubber dam body is prevented.

In the illustrated embodiment of FIG. 50, when the water level at the upstream side reaches the position $L_4$ due to the rising of the water flow, the lever float valve 72 is opened to gradually discharge the fluid (air) filled in the rubber dam body 10 through the small discharge pipe 71 into atmosphere. As a result, the water level drops below the position $L_4$, during which the lever float valve 72 is closed to dam a particular volume of water. If the rising water level reaches the predetermined water level for deflation $L_5$, the main discharge valve 67*b* is opened by buoyancy of the float 67*d* and spring action of the spring 67*f* in addition to the opening of the lever float valve 72. Thus the discharge of the enclosed fluid is also performed through the large discharge pipe 65. Therefore, the rubber dam body 10 is deflated rapidly and completely to release all of the dammed water toward the downstream side.

In the pipe-line of FIG. 50, the difference between the positions $L_4$ and $L_5$ is selected so that the main discharge valve 67*b* is opened after the dam height of the rubber dam body 10 is deflated to a certain extent by the opening of the lever float valve 72, whereby the occurrence of step-wave can be removed surely.

Figure 51:
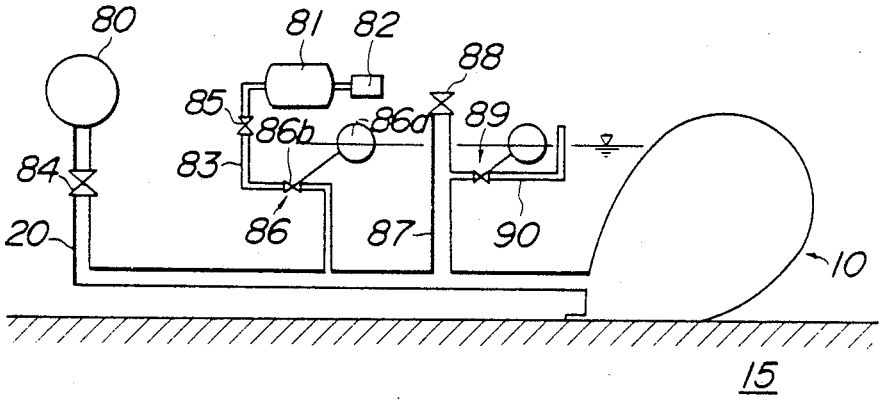

FIG. 51 shows a third modified embodiment of the pipe-line shown in FIG. 47, which achieves automatic control of the dam height.

A fluid, particularly air is mainly supplied from a blower 80 through the fluid entrance pipe 20 into the inside of the rubber dam body 10 extending between both the riverbanks. The internal pressure of the rubber dam body corresponds to about a head pressure for the predetermined dam height in the usual use state, so that is is not economical that the microadjustment control of the internal pressure is performed by using the blower 80 of a large capacity. In the microadjustment control, therefore, air accumulated in a tank 81 by a compressor 82 is supplied into the inside of the rubber dam body through an auxiliary supply pipe 83. In the latter case, an on-off valve 84 disposed in the fluid entrance pipe 20 is closed.

The auxiliary supply pipe 83 brranching from the pipe 20 is provided at its middle position with a reducing valve 85 for reducing the internal pressure of the tank 81 to a value corresponding to the predetermined internal pressure of the rubber dam body, and a lever float valve 86 acting on a position of a float or water level. The lever float valve 86 has the same structure as described in FIG. 48 and comprises a float 86*a* and a closable control portion 86*b* interlocking with the float 86*a* to open and close the pipe 83. That is, the lever float valve 86 acts to close pipe 83 if the water level rises above the predetermined value.

In the illustrated embodiment, a discharge pipe 87 is further branched from the fluid entrance pipe 20. The discharge pipe 87 is provided at one end with a manual discharge valve 88, from which a small discharge pipe 90 branches and is provided at its end or middle portion with a lever float valve 89. This lever float valve 89 has a structure opposite to the mechanism of the lever float valve 86. That is, the lever float valve 89 acts to open the pipe 90 with the rising of water level.

Moreover, when both the auxiliary supply pipe 83 and small discharge pipe 90 is made of a flexible tube, the position of the lever float valves 86 and 89 can be changed easily and also the change of the contemplated water level for deflation is easy. In addition, the manual discharge valve 88 can be replaced by an automatic control valve detecting the contemplated water level to deflate the rubber dam body automatically.

In the operation of the pipe-line shown in FIG. 51, the rubber dam body 10 is primarily inflated by the actuation of the blower 80 and the internal pressure thereof is adjusted by the air supply from the tank 81 to dam water in river.

During the usual water-level regulation, the inflated rubber dam body 10 always dams a constant volume of water.

If the dammed water level rises, however, it is necessary to drop the water level by lowering the dam height. In this case, the lever float valves 86 and 89 are simultaneously actuated at a predetermined water level. That is, the auxiliary supply pipe 83 is closed by the lever float valve 86 to cut off the communication between the tank 81 and the rubber dam body 10, while the small discharge pipe 90 is opened by the lever float valve 89 to communicate the rubber dam body 10 with atmosphere. Thus, the enclosed air is discharged through the discharge pipes 87 and 90 into atmosphere, whereby the dam height is gradually lowered to drop the dammed water level.

When the dammed water level drops to a certain value by the actuation of the lever float valves 86, 89, the pipe 83 is then opened by the valve 86, while the pipe 90 is closed by the valve 89. As a result, air sufficient to compensate for the reduced quantity of the internal pressure is supplied from the tank 81 to again inflate the rubber dam body 10 to the original dam height.

Moreover, when the operating water levels of the lever float valves 86 and 89 are different, i.e. when the operating water level of the valve 86 is somewhat lower than that of the valve 89, there can be obtained a certain region of water level not performing the supply and discharge of air to the rubber dam body. Thus the power of the compressor 82 for the microadjustment control can be reduced.

In the illustrated embodiment, the change of the dammed water level is based on the change of the dam height in the discharge of the enclosed fluid, so that it is preferable that the diameter of each of the pipes 83, 90 is made sufficiently small in order to prevent excessive supply and discharge of the fluid.

Figure 52:
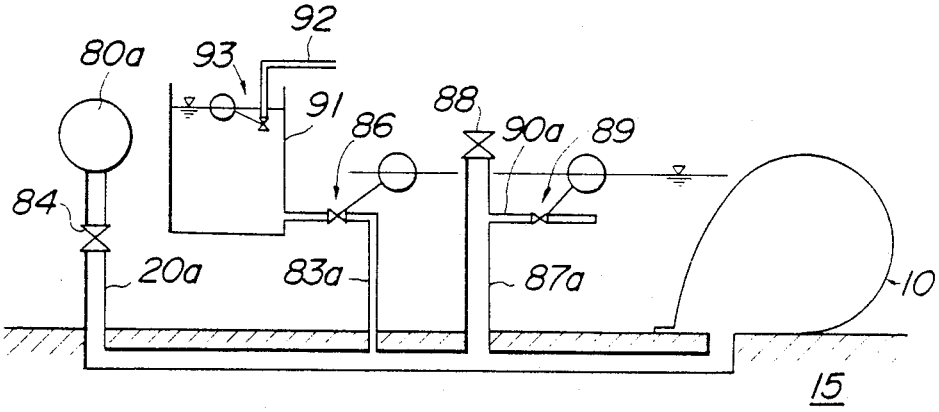

FIG. 52 shows a modified embodiment of the pipe-line shown in FIG. 51 using water as a fluid. In this case, a water tank 91 is used instead of the tank and compressor, a pump 80*a* is used instead of the blower, and pipes 20*a*, 83*a*, 87*a* and 90*a* are used as supply and discharge pipes for water.

The inflation of the rubber dam body 10 is performed by the actuation of the pump 80*a* and the microadjustment control of the dam height is performed by the actuation of the lever float valve 86 in communication with the water tank 91. On the other hand, water is supplied to the tank 91 through a water service pipe 92. In the latter case, the water level in the water tank 91 is constantly maintained by the actuation of a lever float valve 93 permitting the supply of water to the tank 91 when dropping the water level below a predetermined position.

The pipe-line of FIG. 52 develops the same function as described in FIG. 51 for the adjustment of the dam height in accordance with the rise or fall of water.

In the embodiments of FIGS. 51 and 52, when the rubber dam body 10 is completely deflated in the abrupt rising of water level, the on-off valve 84 and a valve disposed in the auxiliary pipe 83 or 83*a* (not shown) are closed. The manual discharge valve 88 is opened to release the dammed water toward the downstream side.

The pipe-lines for supply and discharge of the fluid as illustrated above represent a simple structure and can always maintain a constant demand volume under a reliable actuation. Particularly, when using a plurality of lever float valves, the inflated rubber dam body is deflated gently, so that not only the occurrence of step-wave is prevented, but also a bad influence upon a rubber dam body disposed at a downstream side can be removed. Further, the rubber dam body can dam a particular volume of water until the rising water level reaches to a position of a predetermined water level for deflation, so that the reinflation to the predetermined dam height is easy and consequently the time, fluid supply amount, consumed power and the like required for the reinflation can be considerably reduced as compared with the prior art.

What is claimed is:

1. A collapsible rubber dam secured to a riverbed portion and slope portions of both riverbanks only at an upstream side of a river and inflated and deflated by supply and discharge of a gas, comprising; a pipe for supply and discharge of said gas one end of said pipe communicating with the inside of said rubber dam from only at least one slope portion of said slope portions of both riverbanks exclusive of said riverbed portion securing said rubber dam, said end of the pipe for supply and discharge of gas located in said one slope portion in a triangular region defined by a top end of said rubber dam located in said slope portion, a line connecting said top end of said rubber dam to substantially a middle position of a deflated width of said rubber dam along said riverbed portion, and a securing position of said rubber dam at a toe of the slope portion above an acceptable height of any remaining drainage in said rubber dam.

2. A collapsible rubber dam as claimed in claim 1, wherein said rubber dam is provided at its inside with at least one protruding member having a rigidity resistant to water pressure and extending along the longitudinal direction of said rubber dam.

3. A collapsible rubber dam as claimed in claim 2, wherein said protruding member is a hollow body having a continuous hollow part in its lengthwise direction, which extends substantially over a whole length of said rubber dam and is opened upward at its one end inside said rubber dam.

4. A collapsible rubber dam as claimed in claim 1, wherein said rubber dam is provided at its inside with an elastic member capable of deforming in accordance with an inflating shape of said rubber dam and located in at least a part of said rubber dam along its lengthwise direction.

5. A collapsible rubber dam as claimed in claim 1, wherein a dam height at inflation of said rubber dam is lowered in at least a position along the widthwise direction of said river.

* * * * *